US011877619B2

(12) United States Patent
Caldwell et al.

(10) Patent No.: US 11,877,619 B2
(45) **Date of Patent: *Jan. 23, 2024**

(54) FOOTWEAR SOLE STRUCTURE

(71) Applicant: NIKE, Inc., Beaverton, OR (US)

(72) Inventors: Cailee M. Caldwell, Beaverton, OR (US); Petre Gheorghian, Portland, OR (US); Ryan R. Larson, Portland, OR (US); Troy C. Lindner, Portland, OR (US); Thea Moshofsky, Beaverton, OR (US); Jay T. Worobets, Portland, OR (US); Krissy Yetman, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 169 days.

This patent is subject to a terminal disclaimer.

(21) Appl. No.: 17/331,381

(22) Filed: May 26, 2021

(65) Prior Publication Data

US 2021/0282499 A1 Sep. 16, 2021

Related U.S. Application Data

(63) Continuation of application No. 16/575,375, filed on Sep. 18, 2019, now Pat. No. 11,071,348.
(Continued)

(51) Int. Cl.
*A43B 13/18* (2006.01)
*A43B 13/12* (2006.01)
(Continued)

(52) U.S. Cl.
CPC ..... *A43B 13/181* (2013.01); *A43B 1/0009* (2013.01); *A43B 3/0036* (2013.01); *A43B 13/125* (2013.01); *A43B 13/188* (2013.01)

(58) Field of Classification Search
CPC ... A43B 13/181; A43B 13/125; A43B 13/188; A43B 13/186; A43B 21/26; A43B 7/087;
(Continued)

(56) References Cited

U.S. PATENT DOCUMENTS 2,432,533 A * 12/1947 Meyer ..... A43B 7/06 36/3 B
4,535,553 A * 8/1985 Derderian ..... A43B 13/181 36/28
(Continued)

FOREIGN PATENT DOCUMENTS

CN 1849082 A 10/2006
CN 101299941 A 11/2008
(Continued)

OTHER PUBLICATIONS

Intention to Grant received for European Patent Application No. 19780489.1, dated Oct. 28, 2022, 7 pages.
(Continued)

*Primary Examiner* — Sharon M Prange
*Assistant Examiner* — Haley A Smith
(74) *Attorney, Agent, or Firm* — SHOOK, HARDY & BACON L.L.P.

(57) ABSTRACT

A sole structure for a footwear article includes a system of support structures. Each support structure includes a tubular body with an inwardly curving wall, which compresses under load to attenuate a force or impact and returns to a resting state when the load is removed.

20 Claims, 15 Drawing Sheets

Related U.S. Application Data

(60) Provisional application No. 62/734,026, filed on Sep. 20, 2018, provisional application No. 62/873,086, filed on Jul. 11, 2019.

(51) Int. Cl.
*A43B 1/00* (2006.01)
*A43B 3/00* (2022.01)

(58) Field of Classification Search
CPC .. A43B 7/08; A43B 7/06; A43B 13/20; A43B 1/0009; A43B 3/0036; A43B 3/0063; A43B 3/0042
USPC ..... 36/27, 29, 28, 25 R
See application file for complete search history.

(56) References Cited

U.S. PATENT DOCUMENTS

| | | | | |
|---|---|---|---|---|
| 6,385,864 | B1 | 5/2002 | Sell et al. | |
| 6,874,251 | B2 | 4/2005 | Moretti | |
| 10,010,133 | B2 * | 7/2018 | Guyan | B29C 64/00 |
| 2003/0144071 | A1 | 7/2003 | Dodge et al. | |
| 2005/0252037 | A1 | 11/2005 | Hofmann | |
| 2008/0263894 | A1 | 10/2008 | Nakano | |
| 2010/0112275 | A1 | 5/2010 | Hansen et al. | |
| 2015/0351493 | A1 | 12/2015 | Ashcroft et al. | |
| 2016/0324260 | A1 * | 11/2016 | Guyan | A43B 13/20 |
| 2016/0374428 | A1 * | 12/2016 | Kormann | A43B 23/0215 36/28 |
| 2017/0035145 | A1 | 2/2017 | Schindler et al. | |
| 2019/0231018 | A1 | 8/2019 | Boutin | |
| 2020/0093221 | A1 | 3/2020 | Caldwell et al. | |

FOREIGN PATENT DOCUMENTS

| | | | |
|---|---|---|---|
| CN | 102349726 | A | 2/2012 |
| EP | 0841019 | A2 | 5/1998 |
| TW | M564940 | U | 8/2018 |
| WO | 2017/208979 | A1 | 12/2017 |

OTHER PUBLICATIONS

Intention to Grant received for European Patent Application No. 19780489.1, dated Mar. 21, 2023, 7 pages.
Extended European Search Report received for European Patent Application No. 23164298.4, dated Jul. 4, 2023, 10 pages.

* cited by examiner

FOOTWEAR SOLE STRUCTURE

CROSS REFERENCE TO RELATED APPLICATION

This application is a Continuation of U.S. application Ser. No. 16/575,375, filed Sep. 18, 2019, and entitled "Footwear Sole Structure." U.S. application Ser. No. 16/575,375 claims the benefit of priority to U.S. Provisional Application No. 62/734,026, filed on Sep. 20, 2018, which is incorporated in its entirety by reference herein. U.S. application Ser. No. 16/575,375 also claims the benefit of priority to U.S. Provisional Application No. 62/873,086, filed on Jul. 11, 2019, also incorporated in its entirety by reference herein.

TECHNICAL FIELD

This disclosure relates to a sole structure for a footwear article.

BACKGROUND

Footwear articles often include one or more sole structures that provide various functions. For instance, a sole structure generally protects a wearer's foot from environmental elements and from a ground surface. In addition, a sole structure may attenuate an impact or a force caused by a ground surface or other footwear-contacting surfaces.

BRIEF DESCRIPTION OF THE DRAWINGS

This subject matter is described in detail herein with reference to drawing figures, which are incorporated herein by reference in their entirety.

DETAILED DESCRIPTION

Subject matter is described throughout this Specification in detail and with specificity in order to meet statutory requirements. The aspects described throughout this Specification are intended to be illustrative rather than restrictive, and the description itself is not intended necessarily to limit the scope of the claims. Rather, the claimed subject matter might be practiced in other ways to include different elements or combinations of elements that are equivalent to the ones described in this Specification and that are in conjunction with other present, or future, technologies. Upon reading the present disclosure, alternative aspects may become apparent to ordinary skilled artisans that practice in areas relevant to the described aspects, without departing from the scope of this disclosure. It will be understood that certain features and subcombinations are of utility and may be employed without reference to other features and subcombinations. This is contemplated by, and is within the scope of, the claims.

Figure 1:
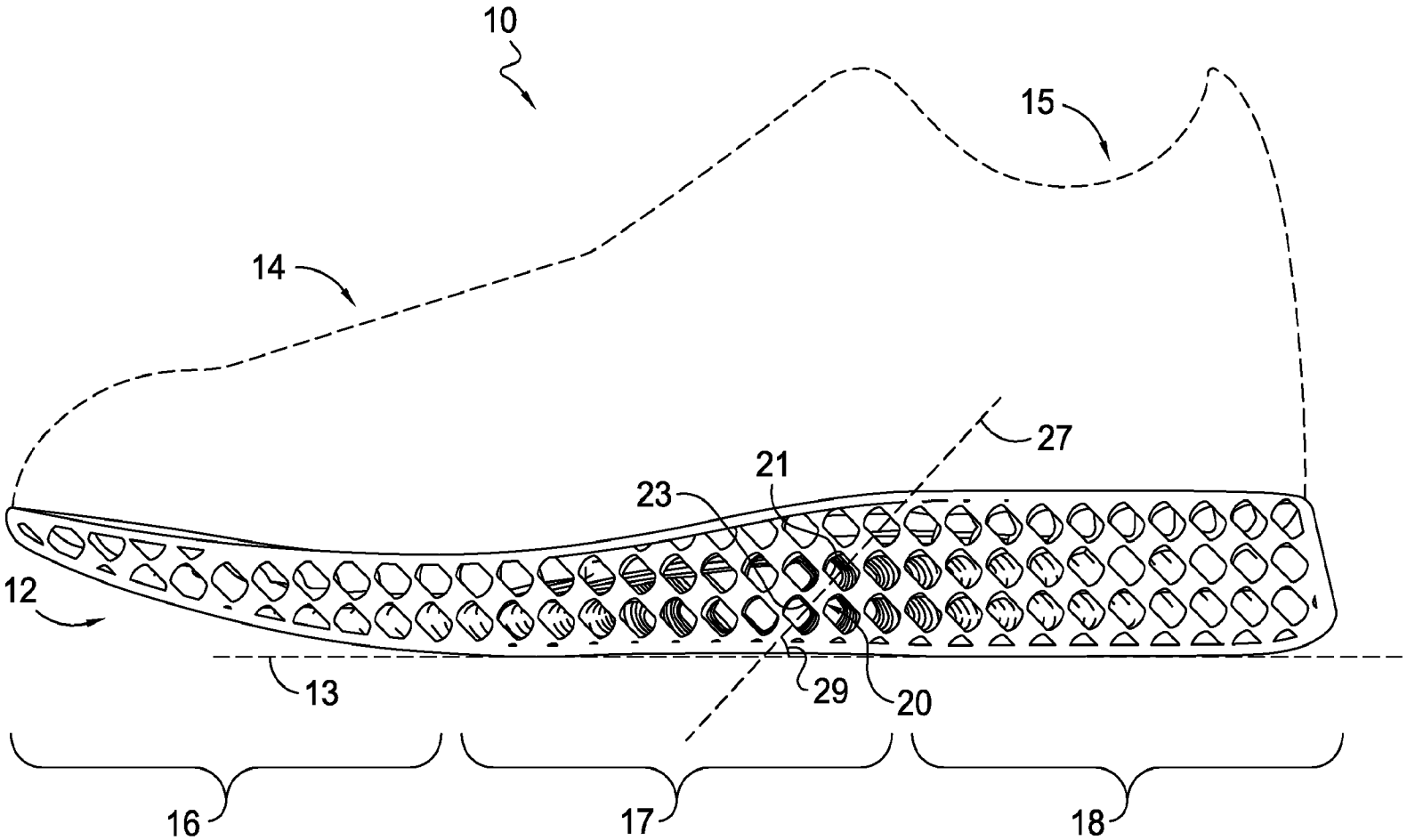
FIG. 1 depicts a side view of a footwear article in accordance with an aspect of this disclosure.

The subject matter described in this Specification generally relates to, among other things, a support structure for a footwear sole, a support system having the support structures for a footwear sole, a footwear sole including the support system, a footwear article, a method of making any of the foregoing, and any combination thereof. An exemplary footwear article 10 having a system of support structures is depicted in FIG. 1. The footwear article includes a sole 12, and the sole 12 includes a plurality of support structures arranged across various regions of the sole 12. One of the support structures is identified with reference numeral 20, and the other support structures might include a same or similar construction.

The system of support structures might be organized into various types of arrangements, such as a matrix or an array including multiple stacked, offset rows of support structures. As described in other parts of this disclosure, the support structures (e.g., support structure 20) operate at an individual structure level, as well as collectively as a system, to provide various functionality for a footwear article. Some of that functionality provided by the sole 12 is generally described in this portion of the disclosure, and subsequent portions of the disclosure provide additional details explaining some of the various aspects and how they operate to provide the functionality. For example, in accordance with aspects of this disclosure, a footwear sole structure may in some instances provide a cushioning functionality, in which the sole absorbs at least a portion of a force, such as by compressing, buckling, collapsing, or any combination thereof, when a wearer's foot strikes a ground surface (e.g., when walking, running, jumping, and the like). In some other instances, the footwear sole structure may also provide an energy-return functionality, in which the sole stores elastic potential energy when absorbing the force and releases kinetic energy upon removal of the force.

As described in more detail in other parts of this disclosure, in accordance with aspects of this disclosure, various factors might contribute to the cushioning functionality and energy-return functionality, such as the configuration of a support structure, the arrangement of a system of support structures, the material(s) from which support structures are constructed, or any combination thereof. In contrast to some traditional sole technology, such as foam soles or alternative cell-based systems, aspects of this disclosure describe a system of support structures that provide cushioning and energy return and that might be lighter weight. In some instances, the lighter weight property (e.g., relative to some traditional foam soles or alternative cell-based systems) results from using less material, since the configuration of each support structure, and the support structures collectively, contributes cushioning and energy return, such that the functioning of the sole is not reliant on only the material properties of the base foam material. Stated differently, some traditional foam soles rely primarily on the material properties of the underlying foam to provide cushioning and energy return, and in contrast, aspects of this disclosure leverage the functional properties of the support structures and support-structure system (in addition to material properties), which allows the use of less material. Furthermore, as compared with alternative cell-based structures that might also utilize 3D-printed structures, the support structures and support-structure systems of this disclosure provide improved cushioning and energy return, which again allows for a materials reduction by reducing cell wall thickness, numbers of cells, and the like while maintaining functionality.

In FIG. 1, the footwear article 10 includes a sole 12 and an upper 14. The upper 14 and the sole 12 generally form a foot-receiving space that encloses at least part of a foot when the footwear is worn or donned. That is, typically a portion of the upper overlaps with, and is connected to, a portion of the sole 12. This overlapping region, and the resulting coupling mechanism (e.g., stitching, bonding, adhering, integrally forming, co-molding, etc.), is sometimes referred to as a "biteline." The foot-receiving space is accessible by inserting a foot through an opening formed by the ankle collar 15. When describing various aspects of the footwear 10, relative terms may be used to aid in understanding relative positions. For instance, the footwear 10 may be divided into three general regions: a forefoot region 16, a mid-foot region 17, and a heel region 18. The footwear 10 also includes a lateral side, a medial side, a superior portion, and an inferior portion.

The forefoot region 16 generally includes portions of the footwear 10 corresponding with the toes and the joints connecting the metatarsals with the phalanges. The mid-foot region 17 generally includes portions of footwear 10 corresponding with the arch area of the foot, and the heel region 18 corresponds with rear portions of the foot, including the calcaneus bone. In addition, portions of a footwear article may be described in relative terms using these general zones. For example, a first structure may be described as being more heelward than a second structure, in which case the second structure would be more toeward and closer to the forefoot. Further, a coronal or transverse plane of the shoe, spaced an equidistance between the forward-most point of the forefoot region and the rearward-most point of the heel region, may be used to describe relational qualities of some parts of a shoe.

The lateral side and the medial side extend through each of regions 16, 17, and 18 and correspond with opposite sides of footwear 10. More particularly, the lateral side corresponds with an outside area of the foot (i.e., the surface that faces away from the other foot), and the medial side corresponds with an inside area of the foot (i.e., the surface that faces toward the other foot). In addition, these terms may also be used to describe relative positions of different structures. For example, a first structure that is closer to the inside portion of the footwear article might be described as medial to a second structure, which is closer to the outside area and is more lateral. In other aspects, a sagittal or parasagittal plane of the shoe, may be used to describe relational qualities of some parts of a shoe. Furthermore, the superior portion and the inferior portion also extend through each of the regions 16, 17, and 18, and the terms superior and inferior may also be used in relation to one another. For example, the superior portion generally corresponds with a top portion that is oriented closer towards a person's head when the person's feet are positioned flat on a horizontal ground surface and the person is standing upright, whereas the inferior portion generally corresponds with a bottom portion oriented farther from a person's head and closer to the ground surface. A transverse plane of the shoe may be used in some aspects to describe relational qualities of some parts of a shoe. These regions 16, 17, and 18, sides, and portions are not intended to demarcate precise areas of footwear 10. They are intended to represent general areas of footwear 10 to aid in understanding the various relative descriptions provided in this Specification. In addition, the regions, sides, and portions are provided for explanatory and illustrative purposes and are not meant to require a human being for interpretive purposes. Although FIG. 1 depicts one certain style of footwear, such as footwear worn when engaging in athletic activities (e.g., cross-training shoes, running shoes, walking shoes, and the like), the subject matter described herein may be used in combination with other styles of footwear, such as dress shoes, sandals, loafers, boots, and the like.

The sole 12 might comprise various components. For example, the sole 12 may comprise an outsole with tread or traction elements made of a relatively hard and durable material, such as rubber or durable foam that contacts the ground, floor, or other surface. The sole 12 may further comprise a midsole formed from a material that provides cushioning and absorbs force during normal wear and/or athletic training or performance. Examples of materials often used in midsoles are, for example, ethylene vinyl acetate (EVA), thermoplastic polyurethane (TPU), thermoplastic elastomer (e.g., polyether block amide), and the like. Shoe soles may further have additional components, such as additional cushioning components (such as springs, air bags, and the like), functional components (such as motion control elements to address pronation or supination), protective elements (such as resilient plates to prevent damage to the foot from hazards on the floor or ground), and the like. As previously indicated, an aspect of the present disclosure includes a midsole having a system of support structures (e.g., support structure 20).

Figure 2:
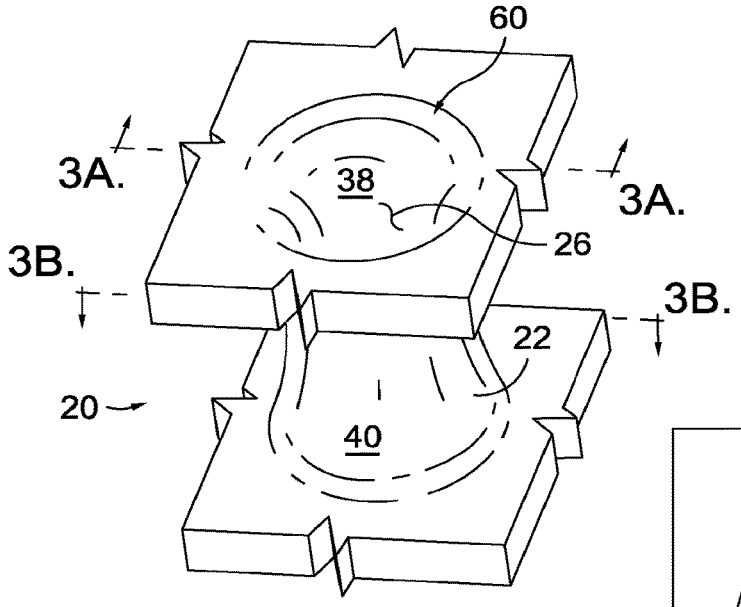
FIG. 2 depicts a support structure in accordance with an aspect of this disclosure.
Figure 3B:
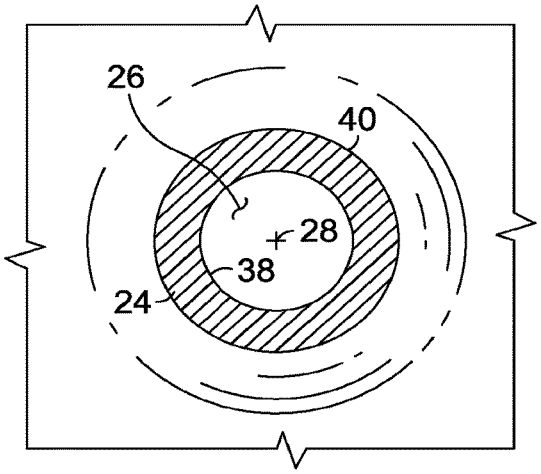
FIGS. 3A and 3B each depicts a respective cross-sectional view of the support structure in FIG. 2 in accordance with an aspect of this disclosure.
Figure 3A:
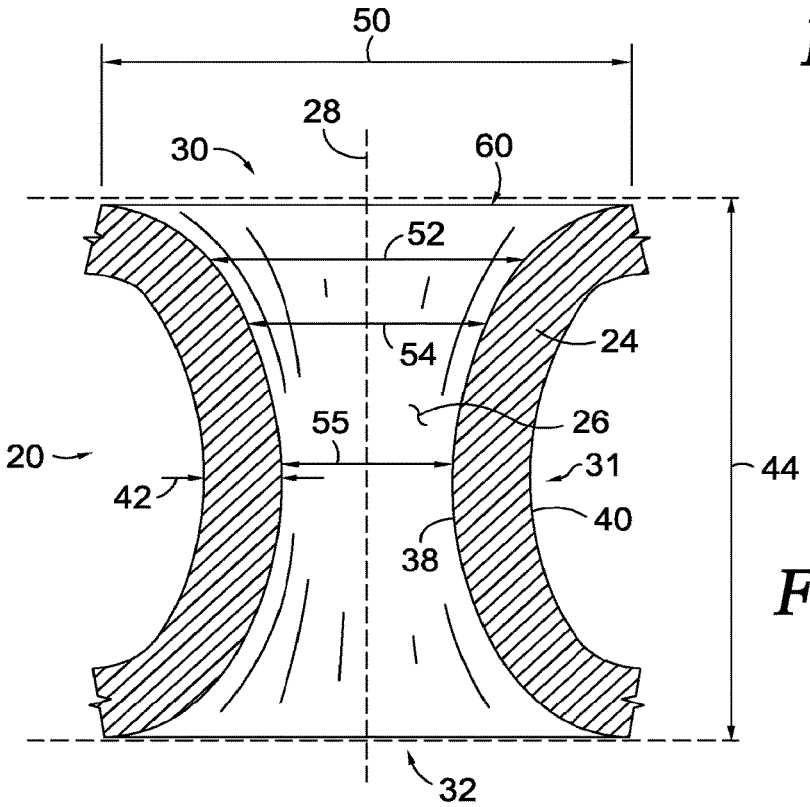

Referring to FIG. 2, the support structure 20 is illustrated in accordance with one aspect of this disclosure, and FIGS. 3A and 3B depict cross-sectional views of the support structure 20 taken at the reference 3A-3A and 3B-3B identified in FIG. 2. In FIG. 2, the support structure 20 is depicted as a discrete element, separate from the sole 12 in FIG. 1, and one aspect of the present disclosure is directed to the discrete support structure 20, either independently from, or included in, a sole. The support structure 20 includes a tubular body 22 including a wall 24 that partially encloses a hollow cavity 26 and that extends circumferentially around a reference axis 28. As used in this disclosure, a reference axis is a reference line that passes through the hollow cavity 26 at a series of points equidistant between opposing sides of the interior surface 38. The wall 24 includes an exterior surface 40 facing away from the hollow cavity 26, an interior surface 38 facing towards the hollow cavity 26, and a wall thickness 42 between the exterior surface 40 and the interior surface 38.

The tubular body 22 includes a first end 30 and a second end 32 that are spaced apart in the axial direction, and the support structure 20 includes a height 44 measured from the first end 30 to the second end 32. The tubular body 22 is open at the first end 30 and the second end 32, such that the wall 24 does not enclose these portions of the tubular body 22. In addition, the tubular body 22 includes one or more diameters (e.g., 50, 52, 54, and 55) that might vary from one portion of the tubular body to another.

Size, shape, dimensions, and other elements of the support structure might be described, defined, or prescribed in various manners. In addition, as is described in other portions of this disclosure, the wall thickness 42, the height 44, and other characteristics might vary depending on various factors. For explanatory purposes, some aspects of these features will be described in this portion of the disclosure with reference to FIGS. 2, 3A, and 3B, and these aspects may be revisited and expanded upon in other parts of the disclosure.

In one aspect of the disclosure, the tubular-wall thickness 42 is in a range of about 0.50 mm to about 1.5 mm. In a further aspect, the tubular-wall thickness 42 is in a range of about 0.75 mm to about 1.25 mm. In a further aspect, the tubular-wall thickness 42 is in a range of about 0.90 mm to about 1.15 mm. In still a further aspect, the tubular-wall thickness 42 is about 1.05 mm. In yet another aspect, the tubular-wall thickness 42 is about 1.15 mm. These are examples of some aspects of the tubular-wall thickness 42, which may vary based on various factors and considerations as will be described in other parts of this disclosure. In other aspects, the tubular-wall thickness 42 may be less than these described ranges, or may be greater than these described ranges.

The support structure 20 also includes the height 44 measured from the first end 30 to the second end 32. In one aspect of the disclosure, the height 44 is in a range of about 0.75 cm to about 1.5 cm. In a further aspect, the height 44 is in a range of about 1 cm to about 1.25 cm. In still a further aspect, the height 44 is about 1.05 cm. In yet another aspect, the height 44 is about 1.15 cm. These are examples of some aspects of the height 44, which may vary based on various factors and considerations as will be described in other parts of this disclosure. In other aspects, the height 44 may be less than these described ranges, or may be greater than these described ranges.

As depicted in FIGS. 2, 3A, and 3B, in some aspects of this disclosure, the wall 24 curves inward as the wall 24 continuously extends between the first end 30 and the second end 32. The curve of the wall, as well as the resulting overall structure of the wall surfaces, might be described in various manners. Furthermore, the curvature of the wall 24 may vary in different aspects. For example, the tubular wall 24 includes the interior surface 38 facing towards the cavity 26, and in one aspect, the interior surface 38 is convex as it extends from the first end 30 to the second end 32, as depicted in FIG. 3A. Furthermore, the interior surface 38 maintains a convex nature from the first end 30 to the second end 32 as the interior surface 38 extends around the reference axis 28. In addition, as depicted in FIG. 3B, the interior surface 38 is concave in a cross-sectional plane extending perpendicular to the axis as the wall 24 extends around the axis 28. The tubular wall 24 also includes the exterior surface 40 facing away from the cavity 26, and in another aspect, the exterior surface 40 is concave as the exterior surface 40 extends from the first end 30 to the second end 32. Similar to the interior surface 38, the exterior surface 40 maintains a concave nature from the first end 30 to the second end 32 as the exterior surface 40 extends around the reference axis 28. Moreover, depicted in FIG. 3B, the exterior surface 40 is convex in a cross-sectional plane extending perpendicular to the axis 28 as the wall 24 extends around the axis 28.

Because of the tubular nature of the support structure 20, the wall 24 includes an interior diameter, and the interior diameter gradually changes from the first end 30 to the second end 32. That is, at each end of the support structure 20, the interior diameter includes a respective value, and the interior diameter gradually decreases as the wall 24 extends away from the ends and curves towards a middle region 31 of the tubular body 22. For example, FIG. 3A depicts a first diameter 50 of the interior surface 38 at the first end 30, a second diameter 52 that is smaller than the first diameter 50, and a third diameter 54 that is smaller than the second diameter 52. In one aspect, each end of the tubular body 22 includes a rim 60, which includes a circumferential portion of the interior surface having a largest diameter before the interior surface either flattens out into a plane or transitions to another structure (as is describe in subsequent portions). In aspects of this disclosure, the diameters of the tubular body 22 may vary. For example, in one aspect, the largest diameter 50 at the rim of each end (i.e., interior diameter) is in a range of approximately 4 mm to approximately 8 mm, and a narrowest interior diameter 55 of the tubular body (e.g., between the ends 30 and 32) is in a range of approximately 2 mm to approximately 5 mm. In light of the range of heights 44 identified above, in one aspect of the disclosure, the support structure 20 includes a height 44 to rim diameter 50 in a range of approximately 1:1 to approximately 4:1.

In one aspect of the disclosure, the curvature of the exterior surface 40 extending from the first end 30 to the second end 32 is a simple curve with a constant radius. In another aspect, the curvature of the exterior surface 40 extending from the first end 30 to the second end 32 is a complex curve with a plurality of different radii. In a further aspect, the curvature of the interior and exterior surfaces remains relatively constant as wall 24 circumscribes the hollow cavity 26. In one aspect, in which the curvature of the exterior surface 40 satisfies a definition for a catenary curve, the tubular body 22 might form a catenoid. In another aspect, the tubular body 22 might form a helicoid.

The configuration of the exterior surface 40, including various qualities such as size and shape, might be determined or defined in other manners. In one aspect of the present disclosure, the exterior surface of the support structure 20 is a minimal surface. In general, a minimal surface includes a zero mean curvature, and a minimal surface may be defined by an equation. Among other things, by using a minimal-surface geometry with curved surfaces for the support structure, force load applied to the support structure 20 might be more evenly distributed throughout the continuous surface of the entire system, as opposed to greater axial distribution that might otherwise occur, such as with struts that intersect one another. In a further aspect, an equation "E1" defining the minimal surface of the exterior surface 40 includes:

$$\sin(x)*\sin(y)+\cos(y)*\cos(z)=0$$

In an aspect of this disclosure, the elements of the support structure 20, such as dimensions and configuration (e.g., curvature of wall), affect the contribution of the support structure to the cushioning functionality of a footwear sole. For example, the dimensions and configuration might affect the rate and consistency at which the support structure 20 compresses under load. Furthermore, the dimensions and configuration might affect the amount of force at which the support structure 20 undergoes an increased rate of compression, similar to a collapsing action, or bottoming out. For example, the omission of flat or planar surfaces, as well as corners, joints, and junctions in the support structure 20, might reduce the likelihood that a compression force will be focused on a fewer number of positions when the support structure is under load, and in this respect, a compression force may be more evenly distributed throughout the entire support structure 20. For example, when a configuration of the exterior surface is a minimal surface, the force-load might be distributed across the entire area of the surface as opposed to a strut-based surface in which the force-load may concentrate in the cross sections of the strut. Among other things, a strut-based system may experience failure in the structure due to repeated bending of the strut elements at positions that bear a larger portion of the force-load.

In another aspect, the structure of the support structure 20 factors into the ability of the support structure 20 to be coupled with other support structures, in a manner that allows the combination of support structures to also contribute to the cushioning functionality. In these respects, the support structure 20 includes features and elements as a basic unit or cell that are important to the functionality of a system as a whole (e.g., system of support structures in a footwear sole), and some of the subsequent aspects of this disclosure will provide additional explanation as to how a system of support structures may contribute to the footwear-sole functionality.

Figure 4:
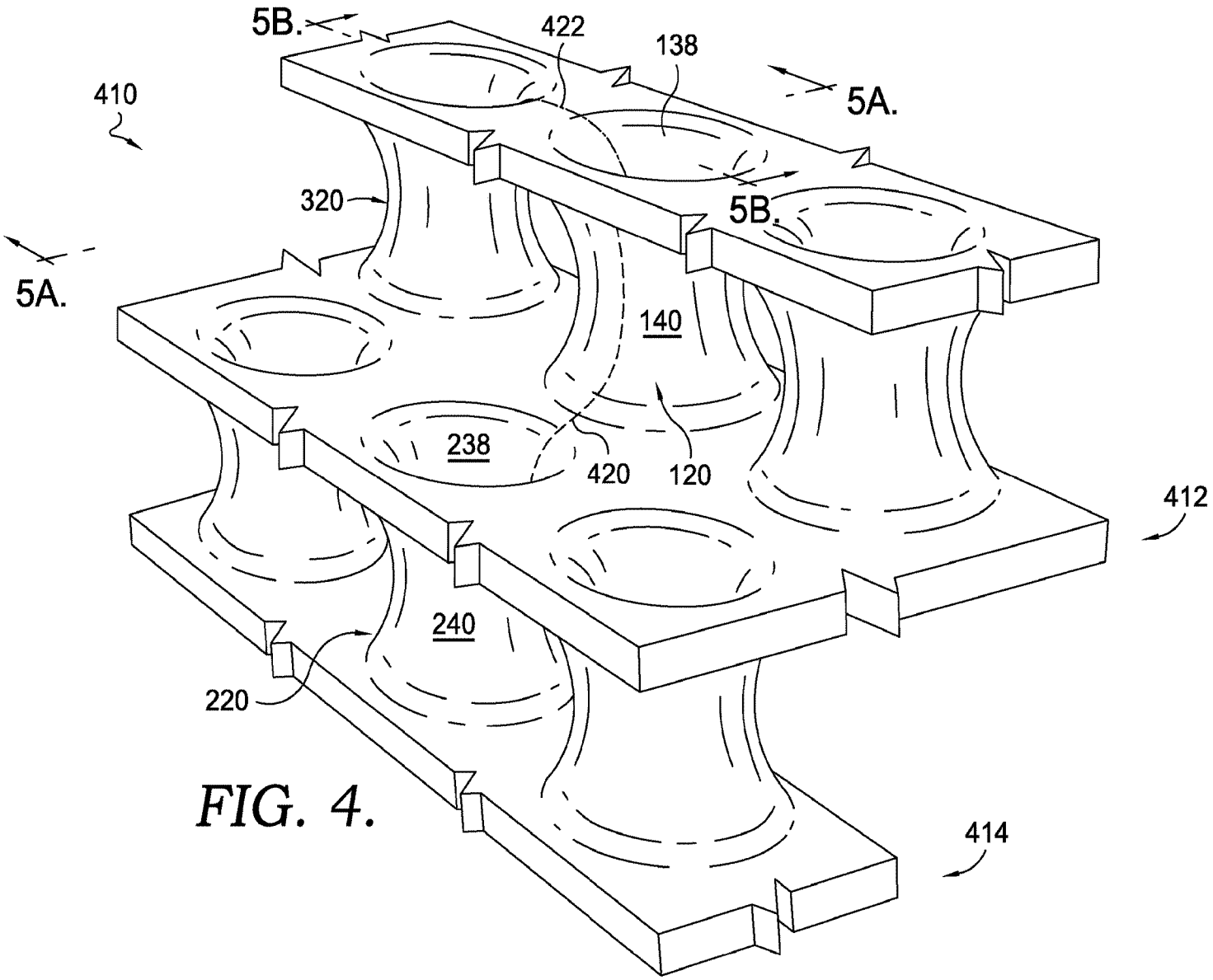
FIG. 4 depicts a first system of support structures in accordance with an aspect of this disclosure.

The support structure 20 may be coupled to one or more other similarly shaped support structures in a support-structure system, which might be configured for integration into a footwear sole. The system of support structures might be organized into various arrangements of rows, columns, matrices, arrays, and the like. For example, referring to FIG. 4, a system 410 of support structures is depicted including a first support structure 120, a second support structure 220, and a third support structure 320. The first support structure 120 and the third support structure 320 are positioned in a same row 412 of support structures, whereas the second support structure 220 is positioned in a second row 414 that is staggered relative to the first row 412. For illustrative purposes, FIG. 5A depicts a cross-sectional view taken at reference plane 5A-5A identified in FIG. 4, and FIG. 5B depicts a cross-sectional view taken at reference plane 5B-5B identified in FIG. 4.

Figure 5A:
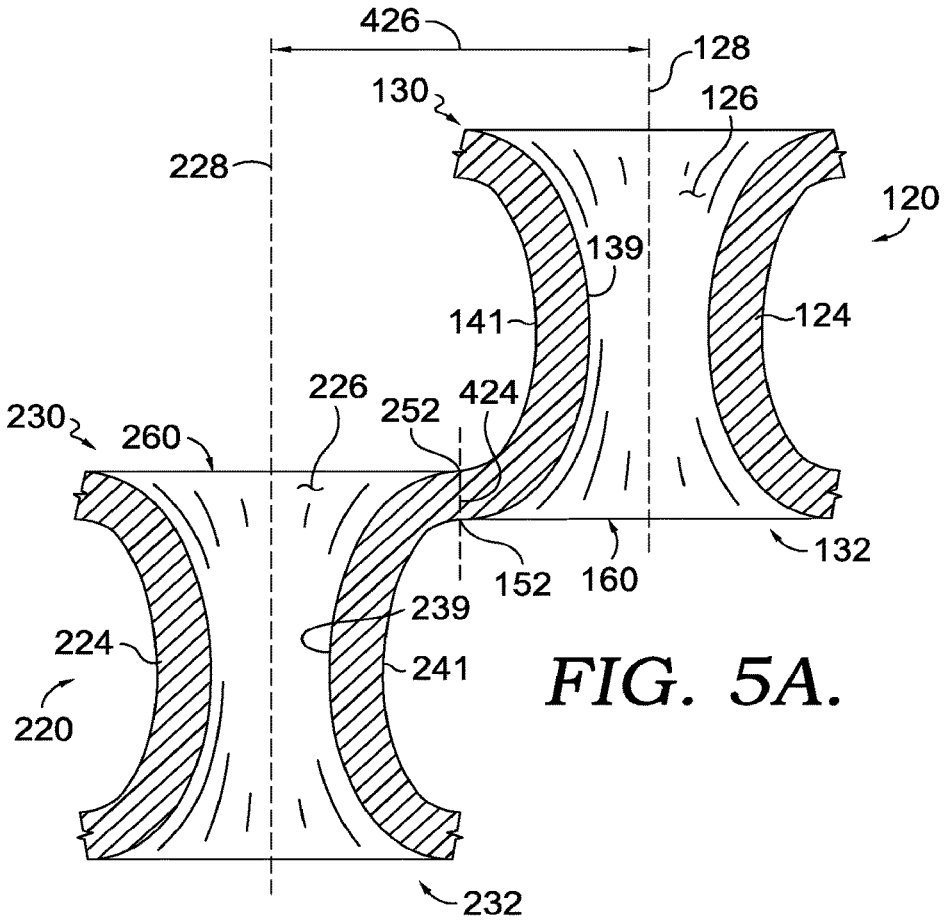
FIGS. 5A and 5B depict different cross-sectional views of the system in FIG. 4 in accordance with an aspect of this disclosure.
Figure 5B:
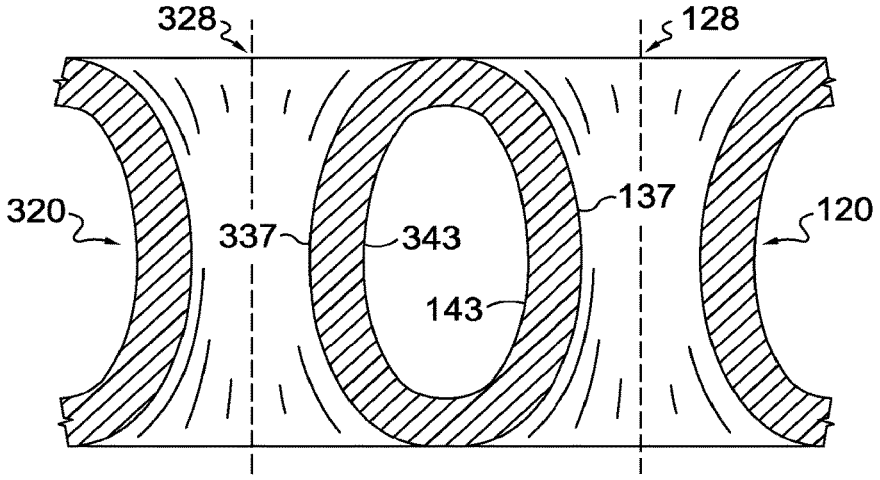

As illustrated in the cross-section depicted in FIG. 5A, the axis 128 of the first support structure 120 in the first row 412 is not coaxial along a common axis with the axis 228 of the second support structure 220 in the second row 414. In this sense, the axis 128 is laterally (or horizontally) offset from the axis 228 (i.e., laterally being opposite or perpendicular to the general longitudinal orientation of the axis). The first and second support structures 120 and 220 are also laterally offset from one another. In addition, the first and second support structures 120 and 220 themselves are longitudinally (or vertically) offset, in the longitudinal direction of the axes. As used herein, the term vertical or vertically refers only to the up-and-down orientation relative to the depiction of FIG. 5A on the page, and vertically does not necessarily refer to the orientation when the support structures 120 and 220 are integrated into a footwear sole. In addition, horizontal or horizontally refers only to the side-to-side orientation relative to the depiction of FIG. 5A on the page and does not necessarily refer to the orientation when the support structures 120 and 220 are integrated into a footwear sole.

The relationship between the first support structure 120 and the second support structure 220 may include additional features or characteristics relating to, and contributing to, at least a portion of the system 410. Furthermore, both the first support structure 120 and the second support structure 220 may include elements consistent with the support structure 20 described in relation to FIGS. 2, 3A, and 3B, and some of these elements are identified in FIGS. 4 and 5A. As such, the first support structure 120 and the second support structure 220 may each include a tubular body including a wall 124 and 224 that at least partially encloses a hollow cavity 126 and 226 and that extends circumferentially around the hollow cavity and the reference axis 128 and 228. In addition, the tubular body of each of the first support structure 120 and the second support structure 220 may include a first end 130 and 230 and a second end 132 and 232 that are spaced apart in an axial direction. Furthermore, the wall 124 and 224 of each of the support structures may curve inward as the wall extends between the first end and the second end, and the wall may include an exterior surface 140 and 240 facing away from the hollow cavity and an interior surface 138 and 238 facing towards the hollow cavity. The support structures 120 and 220 may include any of the additional elements described with respect to FIGS. 2, 3A, and 3B, either independently of one another, or collectively.

As described above, the rows 412 and 414 are staggered, being laterally offset and arranged end-to-end. Accordingly, in one aspect (as illustratively depicted in the cross section of FIG. 5A), the first support structure 120 is partially stacked atop, and staggered relative to, the second support structure 220. Furthermore, one or more surfaces continuously extend from the first support structure 120 to the second support structure 220 to construct respective surface portions of each structure's tubular wall. For example, the dashed reference line 420 (FIG. 4) is illustrated on a single continuous surface including both a first portion of the exterior surface 140 of the first support structure 120 and a first portion of the interior surface 238 of the second support structure 220. In this manner, the dashed reference line 420 illustrates a manner in which the single continuous surface transitions from an exterior surface 140 of one support structure 120 to an interior surface 238 of another support structure 220. In a complimentary manner on an opposite side of the walls 124 and 224 (obscured from view in FIG. 4), a single surface continuously forms, and extends from, the interior surface 138 of the support structure 120 to the exterior surface 240 of support structure 220.

These aspects are also illustrated in the cross section depicted in FIG. 5A, and the reference plane at which the cross section 5A-5A is taken is aligned with the reference line 420. As such, FIG. 5A illustrates a first exterior-surface portion 141 of the first support structure 120 that is continuous with a first interior-surface portion 239 of the second support structure 220. Furthermore, the first exterior-surface portion 141 includes a concave curvature extending between the first end 130 and the second end 132, and the first interior-surface portion 239 includes a convex curvature extending between the first end 230 and the second end 232. As explained above, the single continuous surface transitions from the exterior-surface portion 141 to the interior-surface portion 239. In a complimentary manner, FIG. 5A illustrates an interior-surface portion 139 (convex as it extends between the first end 130 and the second end 132) of the first support structure 120 being continuous with an exterior-surface portion 241 (concave as it extends between the first end 230 and the second end 232) of the second support structure 220.

In one aspect of the disclosure, the first support structure 120 has a second-end rim 160, including a circumferential portion of the interior surface 138, and an edge of the second-end rim 160 abuts a junction 152 with the exterior-surface portion 241 (i.e., the portion at which the interior-surface portion 139 transitions to the exterior-surface portion 241). In addition, the second support structure 220 includes a first-end rim 260, including a circumferential portion of the interior surface 238, and an edge of the first-end rim 260 abuts a junction 252 with the exterior-surface portion 141 (i.e., the portion at which the interior-surface portion 239 transitions to the exterior-surface portion 141). As explained with reference to FIG. 2, the second-end rim 160 and the first-end rim 260 each includes a respective diameter. In a further aspect of the disclosure, the axis 128 and 228 of the first support structure 120 and the second support structure 220 are offset by a distance 426 that is equal to an average of the diameters of the second-end rim 160 and the first-end rim 260. Moreover, the junctions 152 and 252 might be directly opposite one another on either side of the wall in a plane 424 running parallel with both axis.

The junction (e.g., 152 or 353), or the point at which one surface transitions to another surface (e.g., the point at which exterior portion 141 transitions to interior portion 239), might be identified in a various manners. For example, in one aspect of this disclosure, the transition point is located at the position at which a concave exterior surface changes to a convex interior surface. In another aspect, the transition point is located at the position at which a convex interior surface changes to a concave exterior surface. In other aspects, a flat surface may extend between and connect a concave surface and a convex surface, and in that instance, the junction (i.e., transition point) is at the midpoint between the convex surface and the concave surface.

As explained in other portions of this disclosure, the exterior surface of the support structures might include a minimal surface. Among other things, a minimal-surface geometry may help distribute a load more evenly throughout the entire system 410—such as a load applied generally in the axial direction or otherwise. Accordingly, in one aspect the exterior surfaces 140 and 240, including the portions 141 and 241, might both include portions of a minimal-surface structure. For example, the exterior surfaces 140 and 240 of both support structures 120 and 220 might include a catenoid or a helicoid. In one aspect, the exterior surfaces are defined by the equation E1. Furthermore, as explained above, the structure of the support structure 20 factors into the ability of the support structure 20 to be coupled with other support structures, in a manner that allows the combination of support structures to also contribute to the cushioning functionality. This aspect is at least partially illustrated by the reference line 420 showing the continuous surface that smoothly transitions from one support structure 120 to another support structure 220. This aspect is also illustrated by the cross-sectional view of FIG. 5A showing the smooth transition from the wall 124 to the wall 224. The smooth transition minimizes corners or other wall junctions that might otherwise create unequal load distribution. That is, this continuous and smooth transition between support structures helps to reduce the likelihood that a compression force will be focused at fewer locations (e.g., wall joints) and to allow the compression force to be more evenly distributed throughout the entire system of support structures.

FIGS. 4 and 5B also help to show a relationship between the first support structure 120 and the third support structure 320, which are arranged side-by-side, such that the axes 128 and 328 are laterally (or horizontally) offset and are not coaxial along the same axis. But the structures 120 and 320 themselves are not longitudinally or vertically offset from one another or stacked in and end-to-end manner. That is, as between the structures 120 and 320, the rims of at least one of the structures lie in respective planes that are either aligned with a rim of the other structure or are between the rims of the other structure. Support structures that are not laterally axially aligned have axes that are either parallel or skew and are not coaxial.

The third support structure 320 might likewise include the elements described with respect to FIG. 2, such as a wall, first end, second end, interior surface, exterior surface, wall thickness, height, curvature, etc. Furthermore, one or more surfaces continuously extend from the first support structure 120 to the third support structure 320 to construct respective surface portions of each structure's tubular wall. For example, the dashed reference line 422 is illustrated on a single continuous surface and is aligned with the reference plane 5B-5B. FIG. 5B illustrates a second exterior-surface portion 143 of the first support structure 120 that is continuous with an exterior-surface portion 343 of the third support structure 320. Furthermore, the exterior-surface portions 143 and 343 form a continuous closed chain as the continuous surface extends from the first support structure 120 to the third support structure 320, back to the first support structure 120, and so on. FIG. 5B also illustrates a second interior-surface portion 137 (also illustrated by a reference line in FIG. 5A) of the first support structure 120 that is continuous with an interior-surface portion 337 of the third support structure 320. The interior-surface portions 137 and 337 form a continuous closed chain as the continuous surface extends from the first support structure 120 to the third support structure 320, back to the first support structure 120, and so on.

Similar to the explanation of the relationship between the support structures 120 and 220, the continuous surface of 143 and 343 and of 137 and 337 smoothly transitions from one support structure 120 to another support structure 320. The smooth transition minimizes corners or other wall junctions that might otherwise absorb more of a force. That is, this continuous and smooth transition between support structures helps to reduce the likelihood that a compression force will be focused at fewer locations and to allow the compression force to be more evenly distributed throughout the entire system of support structures.

Figure 6A:
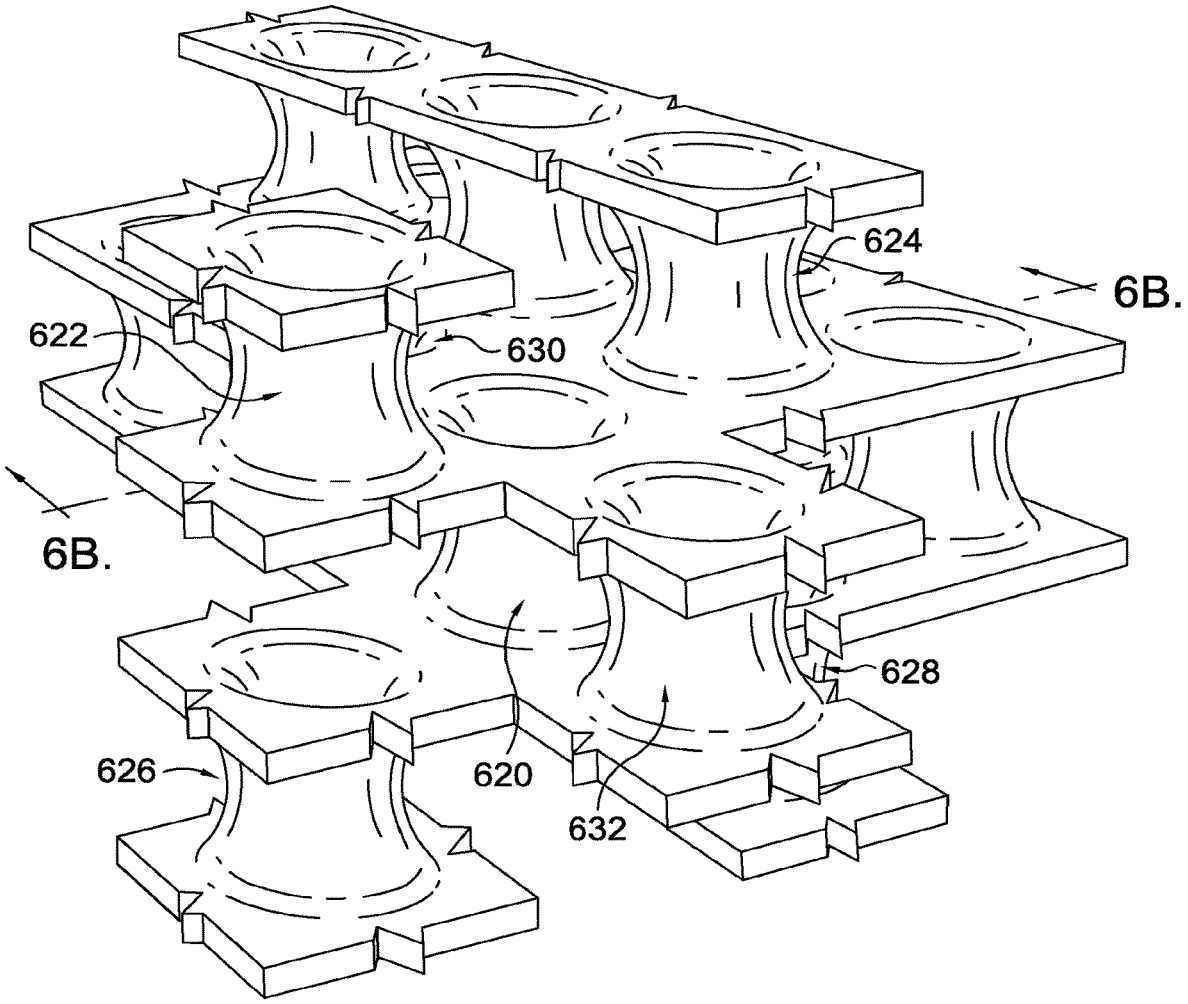
FIG. 6A depicts a second system of support structures in accordance with an aspect of this disclosure.
Figure 6B:
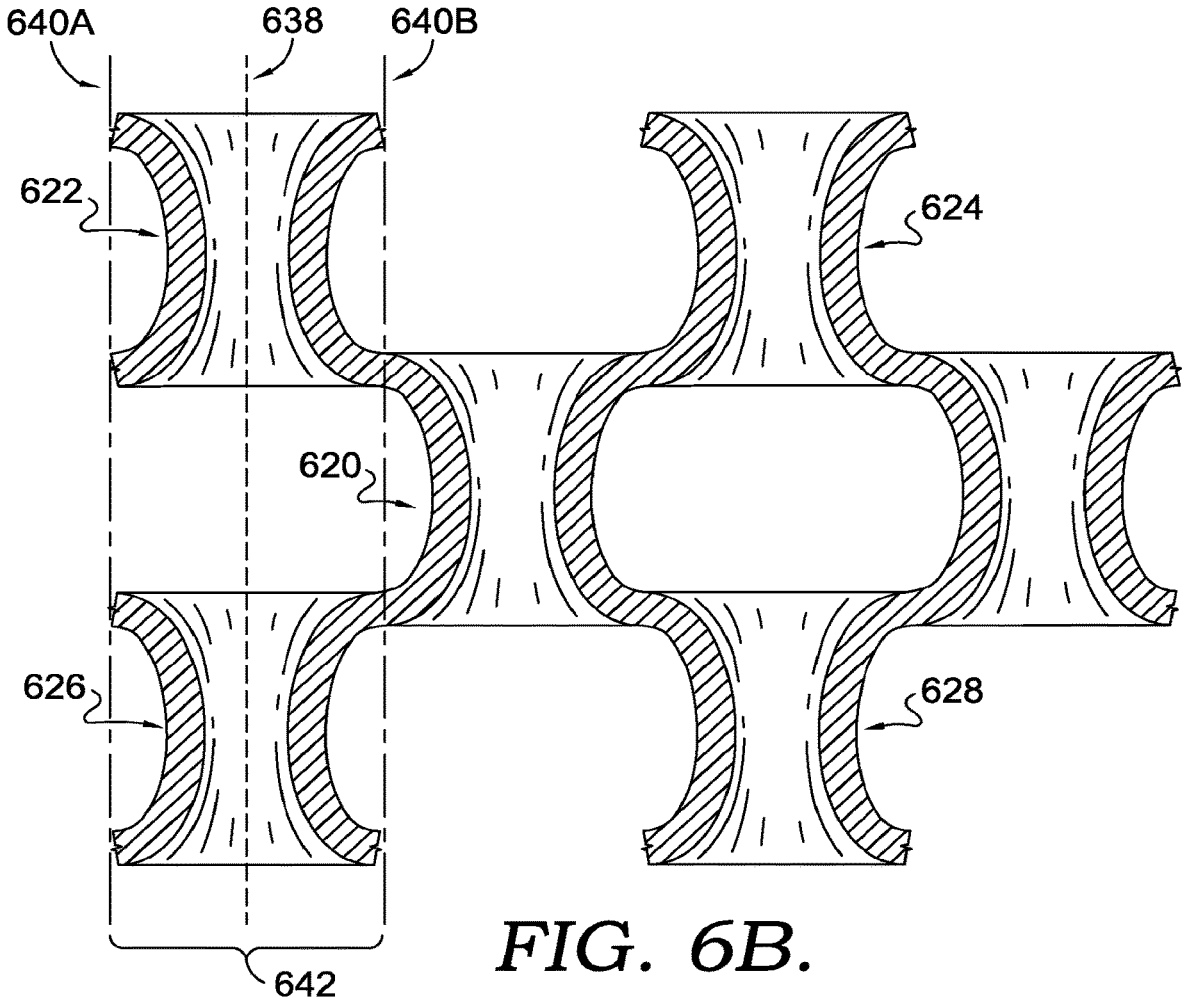
FIG. 6B depicts a cross-sectional view of the system in FIG. 6A in accordance with an aspect of this disclosure.

A system of support structures may be built out even further, and FIG. 6A illustrates another aspect in which additional rows 612 and 614 of support structures have been added to the system 410. (It should be noted that the break lines on the edges of the walls illustrate that the system might be expanded out further with additional support structures adding to the illustrated matrix.) In addition, FIG. 6B illustrates a cross-sectional view showing a relationship between some of the support structures, and illustrating that continuous surfaces may transition from one support structure to another, similar to the manner described in FIGS. 4, 5A, and 5B. Consistent with one aspect of this disclosure, FIG. 6A illustrates that a support structure may have continuous surfaces with at least six other support structures. For example, in FIG. 6B the support structure 620 includes an end-to-end, staggered arrangement with the support structures 622, 624, 626, and 628, and in FIG. 6A the support structure 620 includes a side-by-side relationship with the support structures 630 and 632. It should be noted that the term "stacked" may refer to an end-to-end arrangement, and in FIG. 6B, the support structures 620, 622, and 624 are illustrated on the drawing page as stacked on, and supported by, the support structures 626 and 628. In other aspects, the orientation of the entire system might be rotated clockwise or counterclockwise when integrated into another article, such as a footwear sole, in which case the support structures might still be stacked in a sense of being end-to-end. For example, the support structure 622 and the support structure 620 are end-to-end with one another, and are laterally staggered (e.g., laterally being opposite to the longitudinal orientations of axes).

FIG. 6B illustrates other structural aspects of the system of support structures. For example, some support structures in different rows are coaxial—in other words, the reference axis of a first support structure is aligned with the reference axis of a second support structure along a common axis. For example, the reference axis of the support structure 622 and the reference axis of the support structure 626 are aligned along a common axis 638. These coaxial support structures form columns of spaced apart, coaxial support structures (e.g., they are spaced apart by the staggered, interleaving rows of support structures). For instance, the support structure 622 is spaced apart from the support structure 626 by the staggered, interleaving support structure 620, and reference lines 640A and 640B are provided in FIG. 6B to delineate an example column 642. Support structures arranged in columns may also be referred to as "axially aligned," which describes two or more support structures that are aligned longitudinally (e.g., along the longitudinal orientation of the axis), sequentially (not concentrically) along a common axis, such that the axes of the axially aligned support structures are substantially coaxial.

As explained in other portions of this disclosure, the exterior surface of the support structures 620, 622, 624, 626, 628, 630, and 632 might include a minimal surface. For example, the exterior surfaces the support structures 620, 622, 624, 626, 628, 630, and 632 might include a catenoid or helicoid. In addition, the exterior surfaces might be defined by the equation E1. Among other things, as explained above a minimal-surface geometry may help distribute a load more evenly throughout the entire system 610. In addition, the structure of the individual support structures contributes to each structures ability to connect with adjacent structures in a manner that minimizes high pressure or higher load bearing points.

In an additional aspect of the present invention, a system of support structures is built out across various portions of a footwear sole. For example, the system 610 of FIG. 6 may be extrapolated out from the medial side to the lateral side and from the heel region to the forefoot region to form at least a portion of the sole structure 12 of FIG. 1. In addition, the system 610 might be extrapolated out and only selectively positioned in different parts of a footwear sole. For example, the extrapolated system might be selectively positioned in the forefoot, the midfoot, the heel, the lateral side, the medial side, any portion of the foregoing, and any combination thereof.

A support structure or a system of support structures may have various elements and operations in the context of a footwear sole. For example, in FIG. 1 the footwear sole 12 includes a ground-contacting outsole having two or more ground-contacting surfaces (when the outsole is at rest on a ground surface) positioned in a reference plane 13. In one aspect of the present disclosure, the reference axis of one or more support structures included in the sole (e.g., reference axis 28 of support structure 20) is inclined towards the heel region 18. In other words, the support structure 20 includes a superior end 21 and an inferior end 23, and the superior end 21 is positioned closer to the heel region 18 than the inferior end 23. In addition, the superior end is farther from the outsole than the inferior end 21. As such, in FIG. 1, the reference axis 28 intersects the reference plane 13 at an angle 29 in a range of about 30 degrees to about 60 degrees. In a further aspect, the reference axis intersects the reference plane 13 at an angle 29 of 45 degrees. In other aspects of the disclosure, the angle 29 may be smaller or larger than this range. For example, the angle 29 may be perpendicular to the reference plane 13, or the axis may incline towards the forefoot. The angular orientation of the support structures relative to the ground-contacting surface may, in some aspects, provide an alignment with a direction of a ground force that contributes to an amount of cushioning and responsiveness.

In an aspect of this disclosure, independent support structures, and a system as a whole might compress in various manners when a load is applied. For example, in some aspects, the walls of each support structure fold, bend, or collapse, and this change in state by the walls absorbs at least part of the load (i.e., provides some load attenuation). In addition, the arrangement of the support structures into a system might contribute to the function of the system as a whole. For example, the arrangement of the support structures into a system of continuous surfaces might contribute to a more gradual, even, smooth structure-by-structure collapse as a force is transferred from one part of the system to another. Stated in another way, when a ground force is applied to a first support structure in the system (e.g., foot strike when running), a connected second support structure becomes primed for a gradual collapse, since the continuous surface between the first and second support structures transfers some of the initial force from the first support structure to the second support structure. This continuous surface, and the resulting gradual and relatively linear transfer of force, creates a domino effect from one support structure to the next, which might result in a more even collapse across the system as a whole, as compared with other cell-based or lattice-based systems. In this sense a system of support structures is at least partially a metamaterial, such that the impact-attenuation functionality is derived from characteristics other than the underlying material (e.g., EVA or TPU).

Furthermore, the characteristics of the underlying material may also contribute to the impact-attenuation functionality, and this is described in more detail below. For example, the walls themselves may compress, such that the walls reduce in size under load from a first thickness to a smaller second thickness, to provide additional load attenuation. This aspect of the disclosure in which sole functionality is derived from both the configuration of the support structure(s) and the underlying material might be different from some other footwear soles in which a greater amount of the sole functionality, such as cushioning, is derived from the underlying material (e.g., solid foamed midsoles). By configuring the support structures in a manner that also contributes to sole functionality, such as with even load distribution at least partially attributable to wall configuration, an aspect of this disclosure having the matrix of support structures spaced apart provides a lighter sole as compared with a solid foam midsole.

Various previous portions of this disclosure have described aspects of the support structures and the systems of support structures that contribute to cushioning functionality in a footwear sole while a force is applied. This cushioning functionality is at least partially related to the configuration or shape of the support structures, and some additional aspects of this disclosure are related to methods and materials for making a system of support structures. For example, various different manufacturing techniques and materials may be used, and some techniques and materials may provide confer different traits and qualities to the manufactured support structure.

In one aspect of the present disclosure, a system of support structures is manufactured using a 3D additive-manufacturing technique. In some instances, 3D additive-manufacturing techniques might be better suited than some other manufacturing techniques, such as injection molding or casting, for manufacturing articles having certain geometries. For example, it might be more difficult to construct a system of support structures (e.g., FIGS. 4 and 6A) using injection molding than executing a 3D additive-manufacturing process. Various 3D additive-manufacturing techniques might be used to construct a system of support structures. For example, in one instance a system of support structures might be constructed using selective laser sintering (SLS) or stereolithography (SLA). In another aspect, a system of support structures might be manufactured using a multi-jet fusion technique. Each of these techniques might be optimized based on the material being used, geometry and wall thickness of the part, and target traits for the part, such as by tuning the initial temperature of the machine or material bed and the method and delivery of energy used to bind the base material. For example, when executing a multi-jet fusion technology, each of the steps might be adjusted based on a base material, including the temperature of the material bed and base material, fusing-ink type, fusing-ink temperature, type of energy or heat applied, amount of energy of heat applied, number of fusing-ink passes, speed of fusing-ink pass, and the like.

In one aspect of the disclosure, a system of support structures is manufactured by a 3D additive-manufacturing technique with a base material, and the base material includes a rebound-resilience material property that contributes to the functionality of the system of support structures in a footwear sole. For instance, in one aspect of the present disclosure, the support structures are constructed of a base material having high rebound and being highly resilient. High rebound may be defined as a rebound value of at least a 50%. And in other aspects, the rebound percentage is higher, and may be at least 60%. In a further aspect still, the rebound percentage may be at least 65%. Rebound percentage may be tested using various techniques, such as by using a Schob pendulum or other type of tup or ram. Furthermore, the rebound resilience property of a material might relate to footwear-sole performance in various ways. For example, as described above, the configuration of the individual support structures and the system of support structures contributes to the cushioning functionality and the rebound resilience of the base material might contribute to the energy-return functionality. In other words, the configuration of the individual support structures and the system of support structures might at least partially determine the rate and force at which the sole compresses, and the rebound resilience might at least partially determine the recovery of the sole as the force is withdrawn or removed (e.g., when a foot is pulled or lifted off the ground).

The system of support structures may be constructed of various materials having a rebound resilience that contributes to the energy-return functionality. For example, in one aspect, the system of support structures is constructed of a thermoplastic polyurethane (TPU) having a rebound percentage of at least 50%. In another aspect, the TPU has a rebound percentage of at least 60%. And in a further aspect, the TPU has a rebound percentage of at least 65%. As explained above, a system of support structures might be manufactured using a multi-jet fusion technique, and in one aspect of this disclosure, the technique is tailored to the TPU base material. For example, various steps in the multi-jet fusion technique are tailored to the TPU, including the initial temperature of the base material or material bed before fusing, the fusing-ink type, fusing-ink temperature, type of energy or heat applied, amount of energy of heat applied, number of fusing-ink passes, speed of fusing-ink pass, or any combination thereof.

In a further aspect of this disclosure, the support structures may be tuned across the various zones of the footwear sole to achieve an amount of cushioning and responsiveness. For example, the support structures in the sole 12 might include a consistent wall thickness, height, and angular orientation across all parts of the sole. In another aspect, each of these elements may be varied independently, collectively, and in any combination across different zones or regions of the footwear sole. For example, the wall thickness of a support structure may gradually change from one region of a sole to another region of a sole. In one illustrative aspect, a heel region of a sole includes support structures having a wall thickness of about 0.90 mm; a forefoot region includes support structures having a wall thickness of about 1.15 mm; and the support structures therebetween gradually increase in wall thickness from 0.90 mm to 1.15 mm. This is just one example of how support structure features may vary across a sole. In other instances, a heel region might include support structures with thicker walls, relative to the wall thickness of support structures in the forefoot. Likewise, a medial side might include support structures with different characteristics than a lateral side. Various other qualities may also be tuned across a system of support structures, such as the matrix structure, material, and addition of another material to fill in gaps between support structures and/or the hollow cavities among the support structures.

In another aspect support-structure dimensions may be tuned based on various factors. For example, a wall thicknesses may be increased in one or more regions of a sole for wearers that create greater force when contacting a ground surface, due to body weight, activity, running form, and the like. In another example, wall thickness may be tuned to either complement or correct a wearer's running gait, stride, foot strike (e.g., degree of pronation). As such, in accordance with an aspect of this disclosure, a sole having a system of support structures may be customized for a particular wearer based on shoe size, body weight, activity type, movement biomechanics, desired level of cushion, desired level of responsiveness, or any combination thereof. Aspects of this disclosure are particularly well suited for customization based on the ability to implement changes in a footwear sole that are humanly perceptible (based at least on subjective feedback) by making relatively small changes to the support-structure dimensions. For example, testing shows that some users wearing footwear, which has a sole constructed using the support structures described in this disclosure, can subjectively detect as small as a 0.05 mm change in support-structure wall thickness (e.g., change in the feel of the cushion or of the responsiveness). As used herein, the term "movement biomechanics" describes the quantitative and qualitative categorization of the plurality of positions of a wearer's body at each stage of a movement, including running, walking, and jumping. In addition to tuning the individual support structures, the overall configuration of a midsole may be tuned according to the above described factors. For instance, a heel region may be thicker than other regions of the midsole. In other aspects, a lateral and/or medial peripheral portion may be thicker than more centrally located zones.

FIGS. 7A-C, 8A-C, and 10A-C each depict different sole structures in accordance with aspects of this disclosure. In one aspect, various programming techniques may be utilized to create a sole structure, such as those depicted in FIGS. 7A-C, 8A-C, and 10A-C. For example, the computer-aided design applications sold under the trademarks Rhinoceros® or Grasshopper®, or other visual programming tools or languages, may be used, in which case an explicit definition might be created to define the minimal surface of the support-structure exterior surface. (The Rhinoceros® and Grasshopper® computer-aided design applications are available from, and the Rhinoceros® and Grasshopper® trademarks are the property of, TLM, Inc., doing business as Robert McNeel & Associates of Seattle, Wash.) That is, an explicit Grasshopper® definition may be created that can be used to create a support structure having a minimal-surface equation, such as E1. Using that Grasshopper® definition, various other parameters might be specified, such as wall thickness, sole perimeter shape, sole thickness, sole size, sole foot-bed topography, and sole outsole topography. With the parameters, the Grasshopper® definition can conform the support structures to the defined surfaces and populate the space or envelope therebetween. In a further aspect, the explicit definition is customizable based on various factors, such as by adjusting wall thickness, support-structure height, axis orientation, and the like.

Figure 7A:
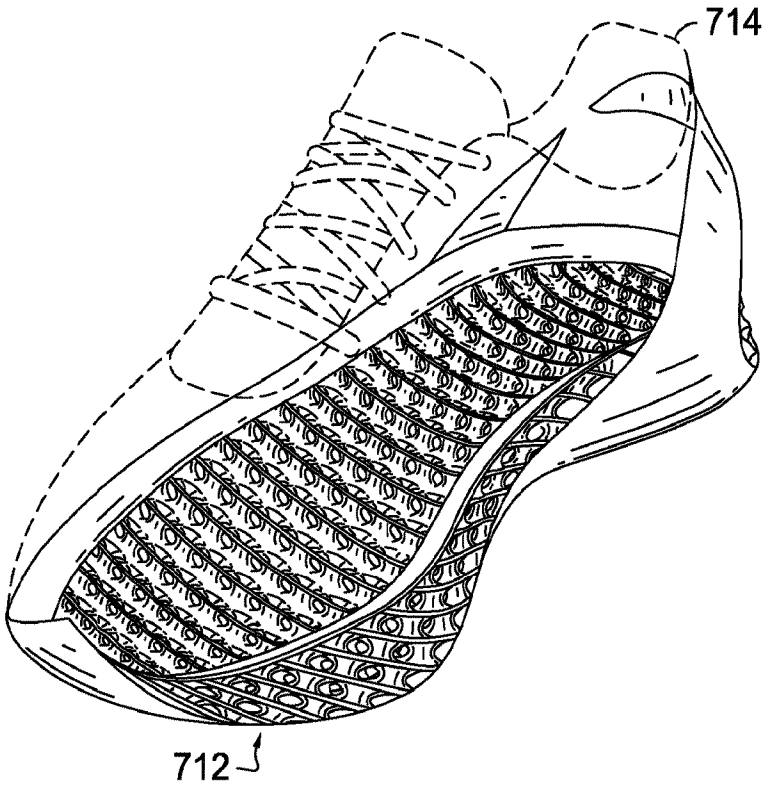
FIGS. 7A, 7B, and 7C each depicts a respective view of a footwear article in accordance with an aspect of this disclosure.
Figure 7B:
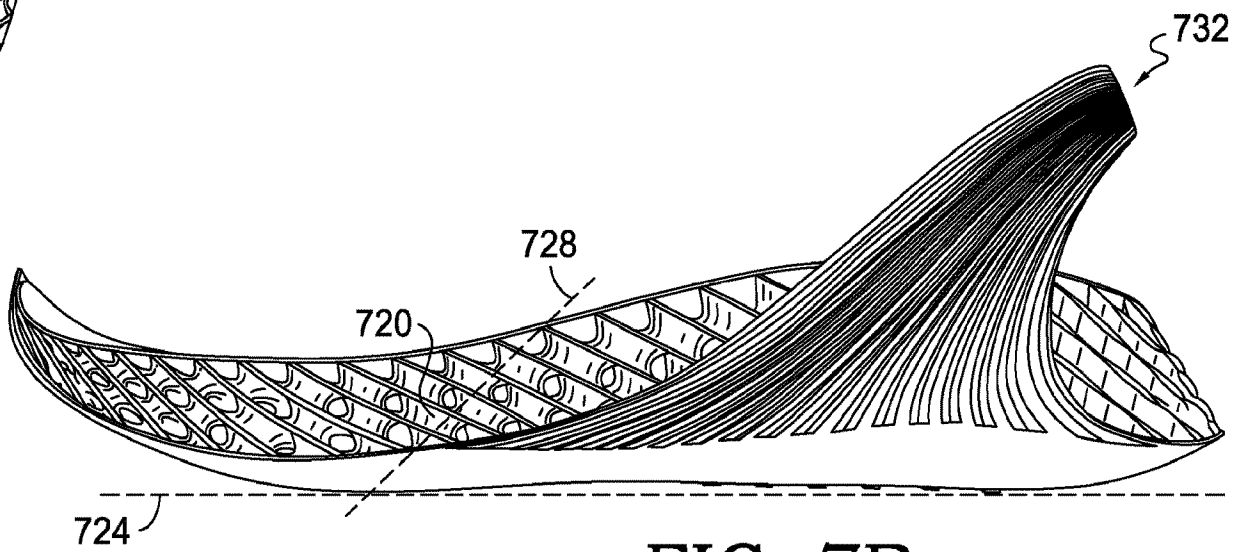
Figure 7C:
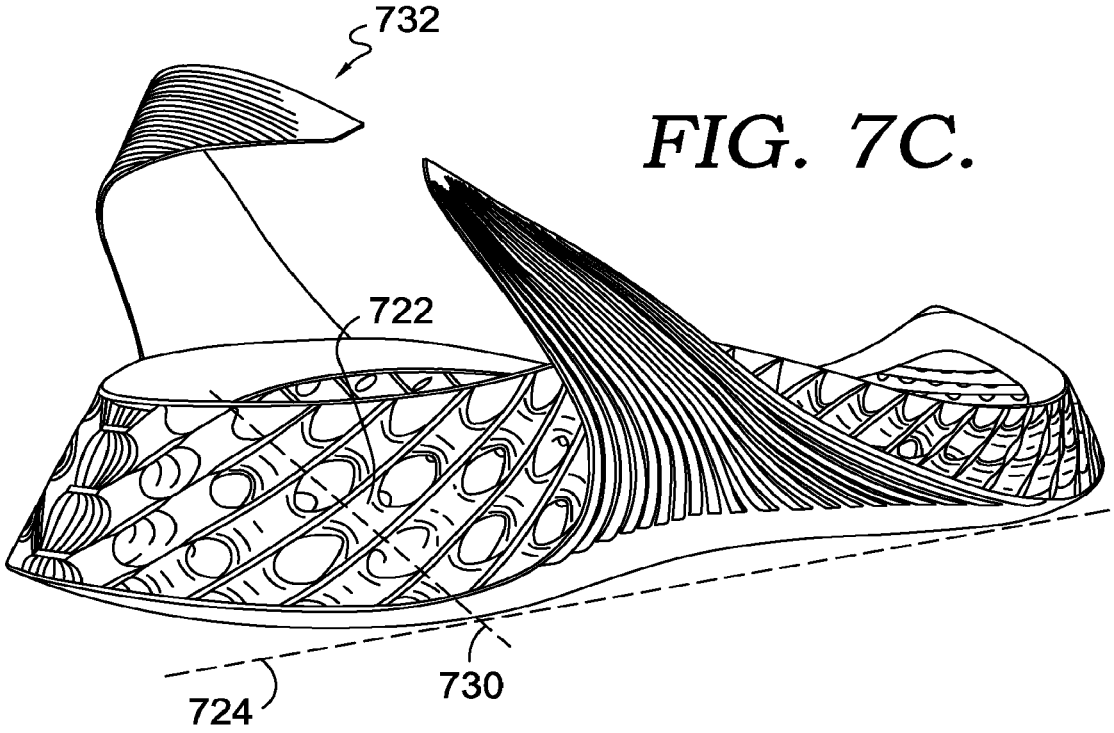

FIG. 7A-7C include a sole 712 having a system of support structures (e.g., 720 and 722), and at least some of the support structures include features similar to those described with respect to the support structure 20 of FIG. 2. For example, the support structures constructing the sole 712 may include tubular bodies having inwardly curving walls. In another aspect, the exterior surfaces of the inwardly curving walls may be defined by a minimal-surface equation, such as E1. In a further aspect, a ground-contacting outsole of the sole 712 includes two or more surfaces positioned in a reference plane 724, and the support structures may include a reference axis 728 and 730 that is angled relative to the reference plane. The sole 712 may include a system of support structures similar to the system 610 described with respect to FIG. 6. For example, continuous surfaces may transition from one support structure to adjacent support structures in a manner that might contribute to even distribution of force load and load attenuation. For the sake of brevity, all of the features of the support structures described with respect to FIGS. 1-6B are not reiterated here, but it is understood that the support structures and system of support structures of the sole 712 may include all of those features.

Furthermore, as an alternative to the system 610, the sole 712 may include support structures 720 and 722 having respective axis that are not parallel with one another and that are skew (relative to one another), but that have a similar angle with respect to the reference plane 724. The orientation of the axis is another characteristic that may be adjusted, customized, or tuned based on a particular wearer. In an additional aspect of the disclosure, a first region of the sole 712 may include support structures with axis in a first orientation; a second region of the sole 712 may include support structures with axis in a second orientation that is different from the first orientation; and the axis orientation of support structures between the first and second regions may gradually change from the first orientation to the second orientation.

In a further aspect, the sole 712 includes a heel strap 732 that is coupled to the sole 712 and that extends around the back of the upper 714. The heel strap 730 may be integrally formed (e.g., 3D printed, molded, cast, etc.) with the sole 712 or may be affixed after the sole 712 is formed, such as by using an adhesive. Among other things, the strap may provide additional stability, fit, durability, and the like.

Figure 8A:
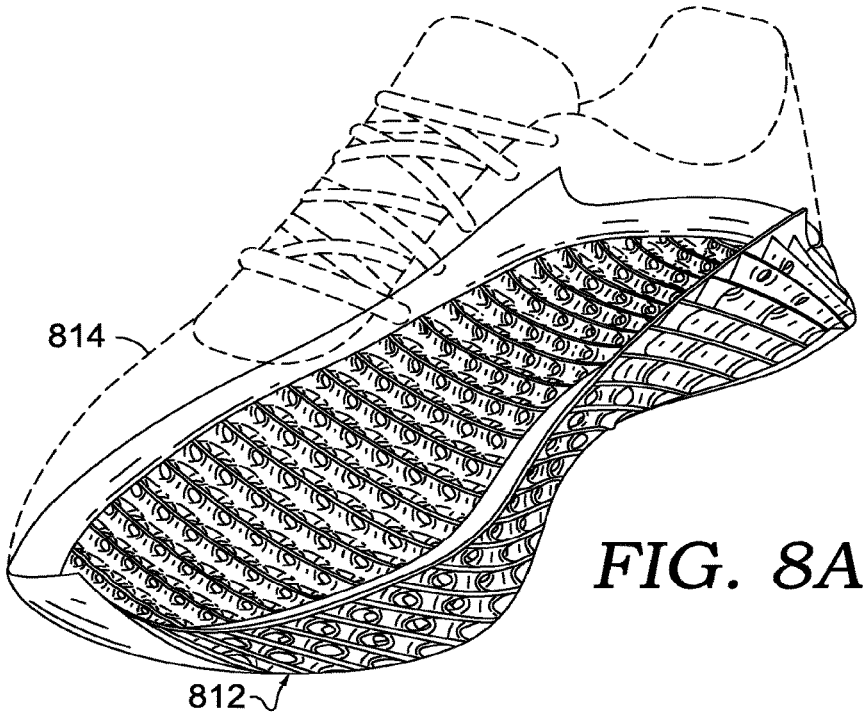
FIGS. 8A, 8B, and 8C each depicts a respective view of a footwear article in accordance with an aspect of this disclosure.
Figure 8C:
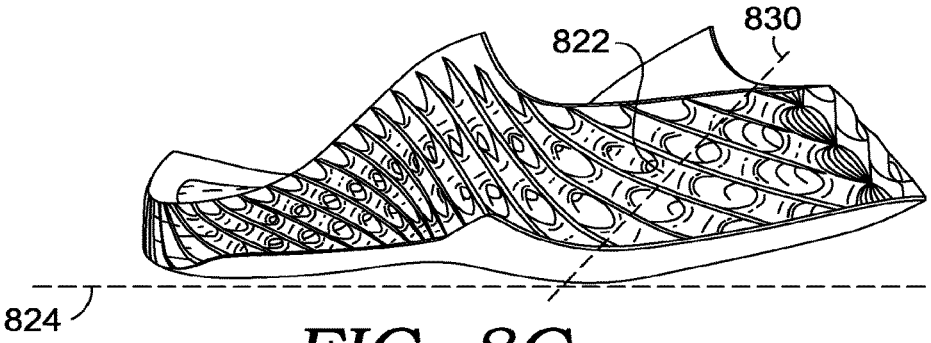
Figure 8B:
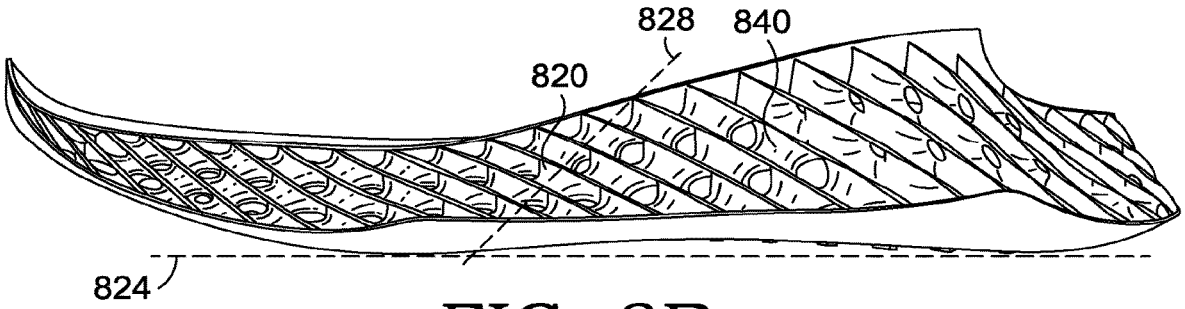

FIGS. 8A-8C includes a sole 812 having a system of support structures (e.g., 820 and 822), and at least some of the support structures include features similar to those described with respect to the support structure 20 of FIG. 2. For example, the support structures constructing the sole 812 may include tubular bodies having inwardly curving walls. In another aspect, the exterior surfaces of the inwardly curving walls may be defined by a minimal-surface equation, such as E1. In a further aspect, a ground-contacting outsole of the sole 812 includes two or more surfaces positioned in a reference plane 824, and the support structures may include a reference axis 828 and 830 that is angled relative to the reference plane. The sole 812 may include a system of support structures similar to the system 610 described with respect to FIG. 6. For example, continuous surfaces may transition from one support structure to adjacent support structures in a manner that might contribute even distribution force load and load attenuation. For the sake of brevity, all of the features of the support structures described with respect to FIGS. 1-6B are not reiterated here, but it is understood that the support structures and system of support structures of the sole 812 may include all of those features.

Similar to the sole 712, the sole 812 may include support structures 820 and 822 having respective axis that are not parallel with one another and that are skew (relative to one another), but that have a similar angle with respect to the reference plane 824. In another aspect of the disclosure, the heights of some support structures (e.g., 840) may be larger than other support structures. For example, in the sole 812, support structures around the periphery edge of the sole 812 that transition from the midfoot region to the heel region are taller than other support structures in the sole 812. Visually in FIGS. 8A-8C, these taller support structures have the appearance of being drawn upward or stretched relative to other support structures in the sole. Among other things, these taller peripheral regions of the sole 812 may contribute to lateral stability. In addition, these regions may provide an anchor surface for attaching the upper 814 to the sole 812 (e.g., in the biteline region using an adhesive or other bonding agent). Furthermore, by gradually increasing the support-structure height, as opposed to simply stacking additional support structures, the integrity of the matrix may be maintained in a manner that contributes to even distribution of force load.

Figure 10A:
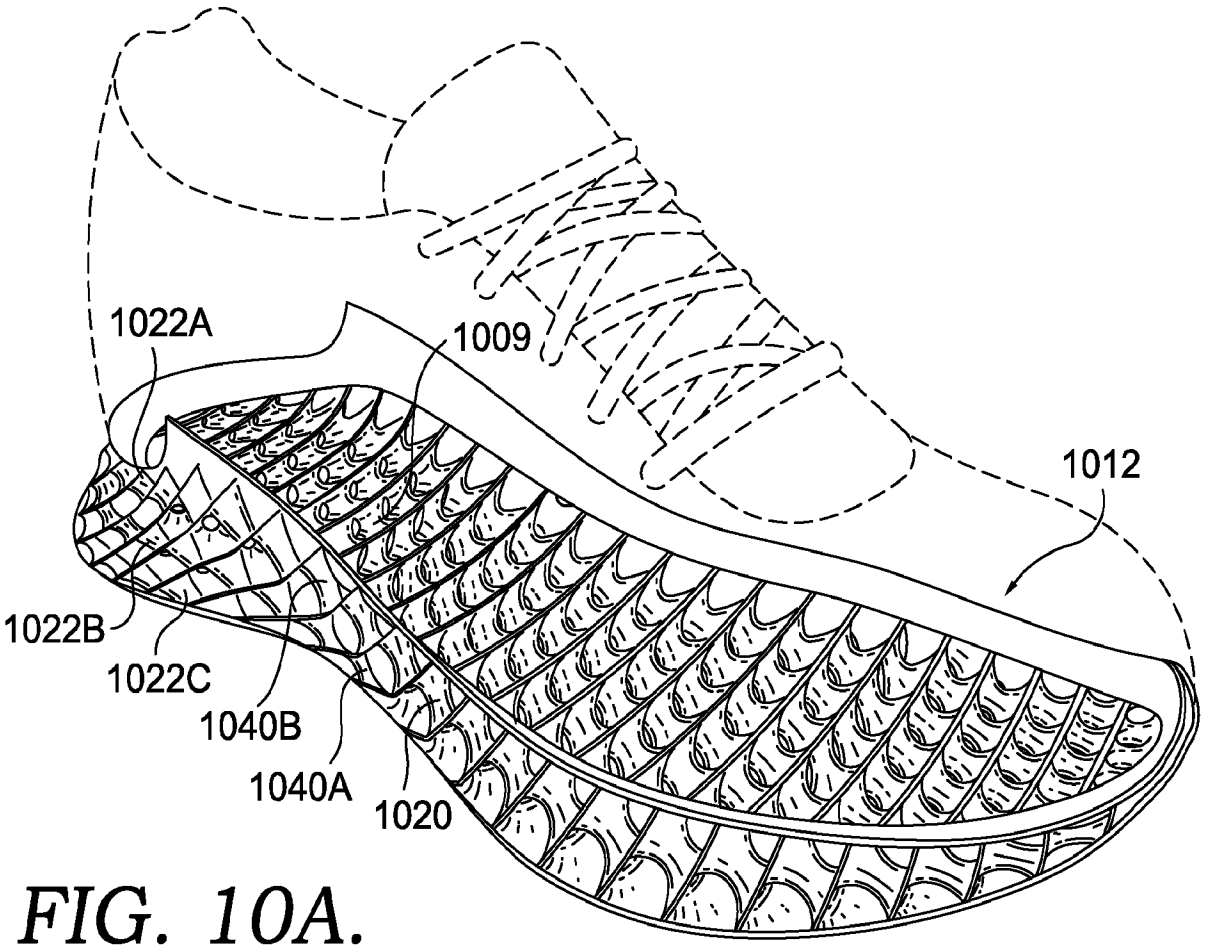
FIGS. 10A-10C depict a respective view of a sole in accordance with an aspect of this disclosure.
Figure 10B:
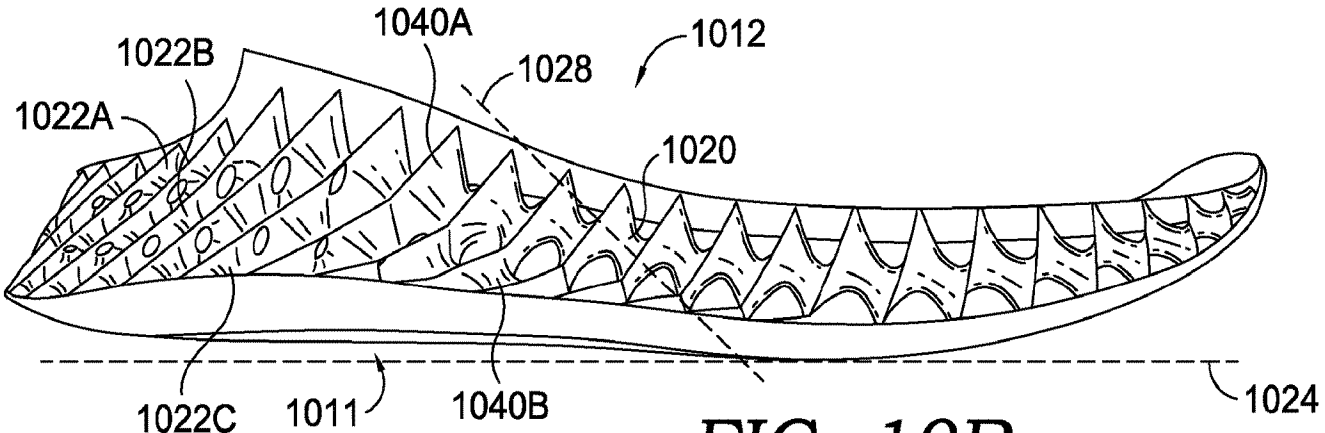
Figure 10C:
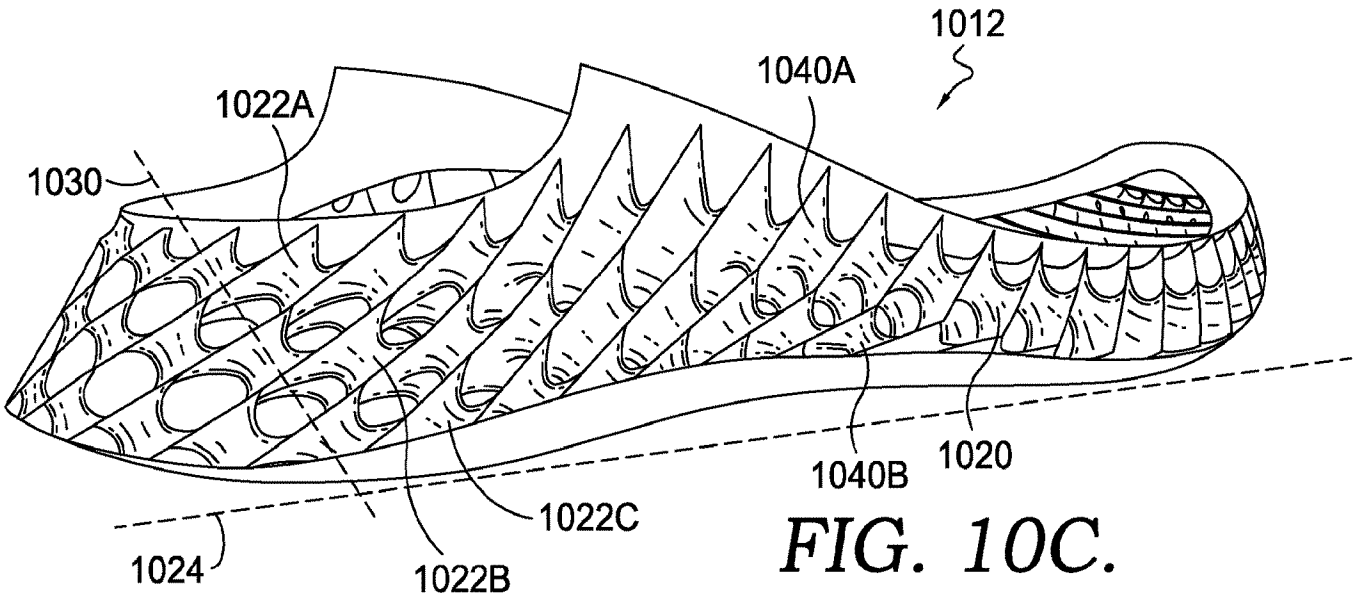
Figure 11A:
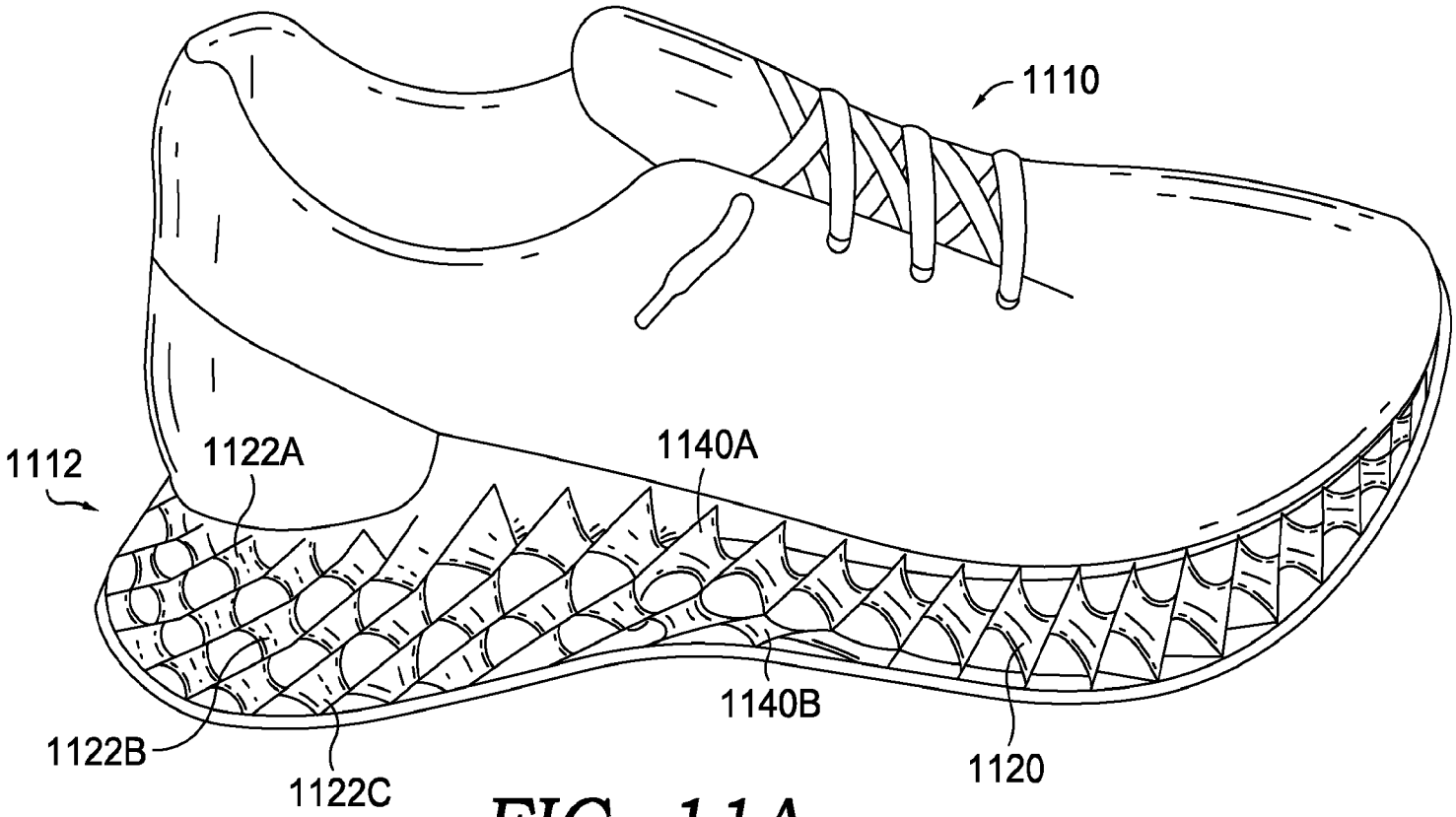
FIGS. 11A-11E depict a respective view of a footwear article having a sole structure with an aspect of this disclosure.
Figure 11B:
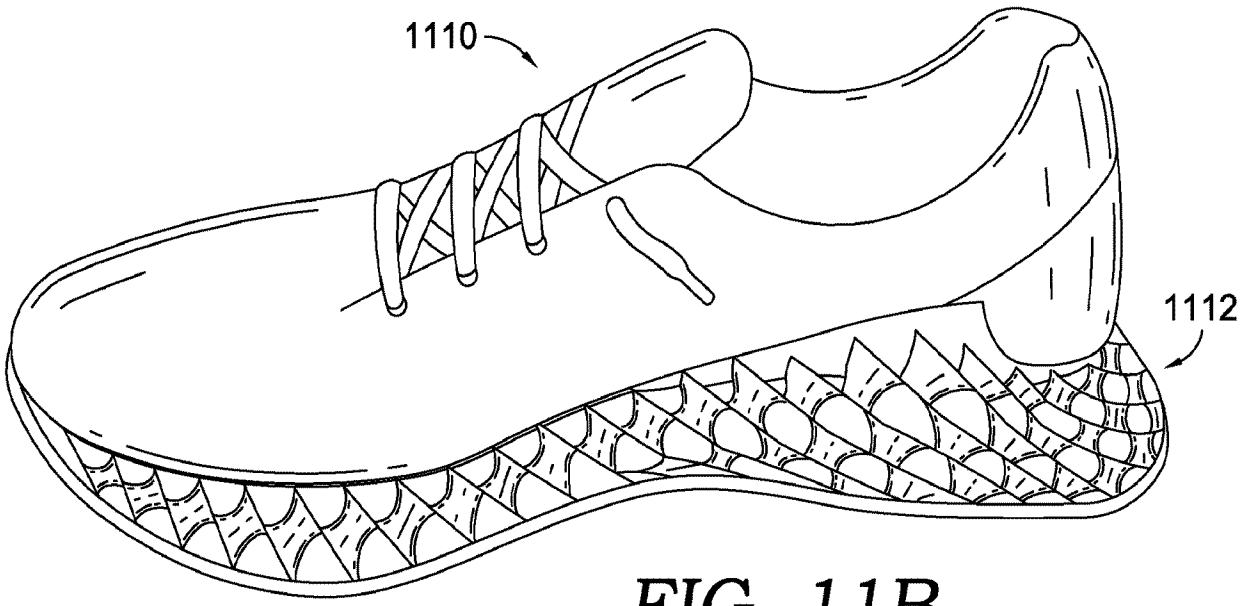
Figure 11C:
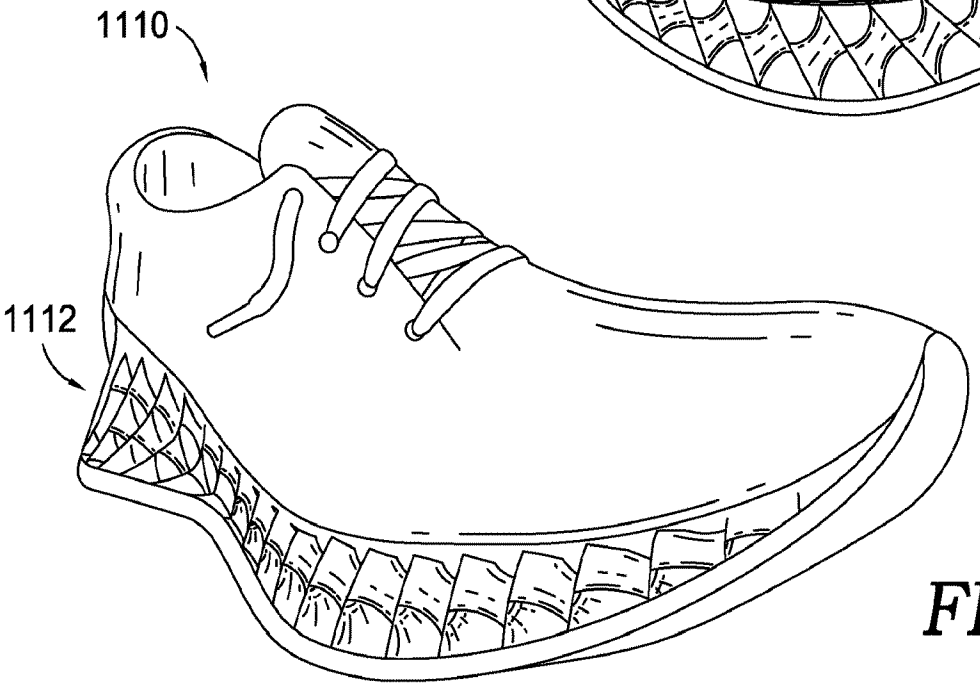
Figure 11D:
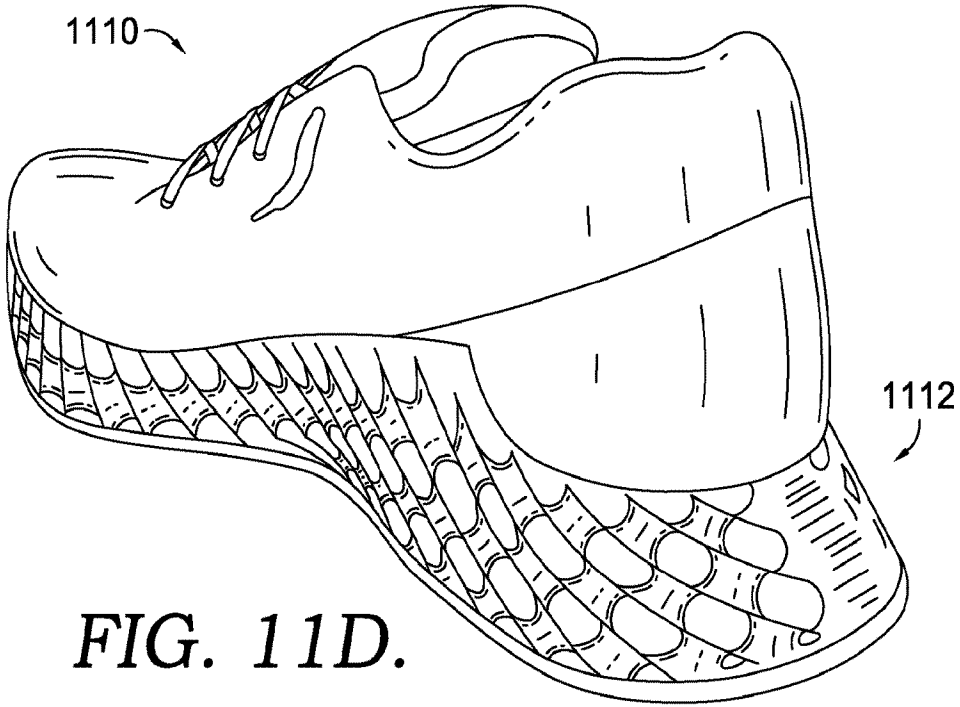
Figure 11E:
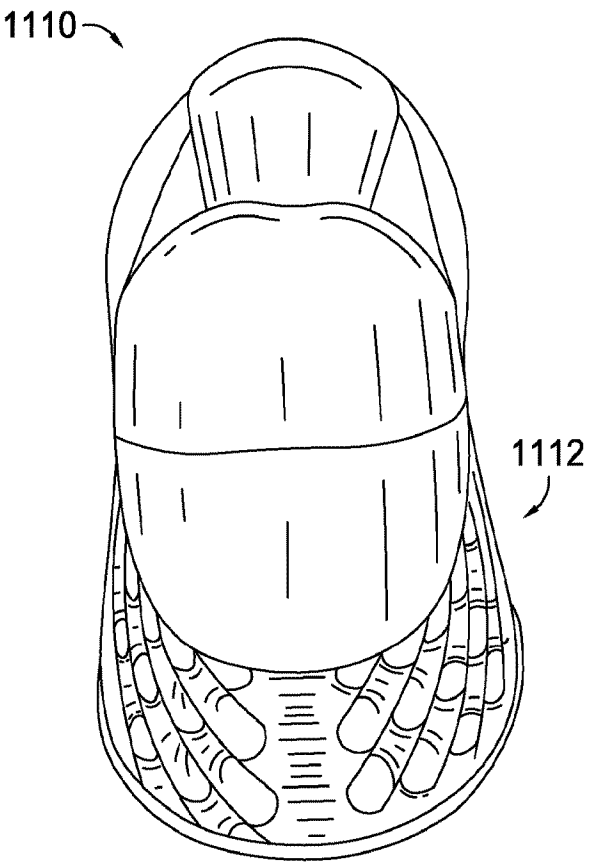

FIGS. 10A-10C include a sole 1012 having a system of support structures (e.g., 1020 and 1022A-C and 1040A-B), and at least some of the support structures include the features described with respect to the support structure 20 of FIG. 2. For example, the support structures constructing the sole 1012 include tubular bodies having inwardly curving walls. In another aspect, the exterior surfaces of the inwardly curving walls may be defined by a minimal-surface equation, such as E1. In a further aspect, a ground-contacting outsole of the sole 1012 includes two or more surfaces positioned in a reference plane 1024, and the support structures may include a reference axis 1028 and 1030 that is angled relative to the reference plane. The sole 1012 may include a system of support structures similar to the system 610 described with respect to FIG. 6. For example, continuous surfaces may transition from one support structure to adjacent support structures in a manner that might contribute even distribution force load and load attenuation. For the sake of brevity, all of the features of the support structures described with respect to FIGS. 1-6B are not reiterated here, but it is understood that the support structures and system of support structures of the sole 1012 may include all of those features.

The sole also includes a footbed surface 1009 and an outsole surface 1111. In an aspect of the disclosure, the system of support structures of the sole 1012 generally transitions from a first region (e.g., the heel region) to a second region (e.g., the midfoot region or the forefoot region). In the first region, the system of support structures are arranged into staggered rows of support structures (e.g., FIG. 6A), and some of the support structures in different rows are coaxial—in other words, the reference axis of a first support structure is aligned with the reference axis of a second support structure along a common axis. These coaxial support structures form columns of spaced apart, coaxial support structures (e.g., they are spaced apart by the staggered, interleaving rows of support structures), spanning the distance between the footbed surface 1009 and the outsole surface 1011. For example, in FIGS. 10A-10C, the heel region of the sole 1012 includes one or more columns of three support structures, such as the three support structures 1022A, 1022B, and 1022C (also referred to herein as a "three-stack arrangement). Having respective axes aligned along a common axis. In addition, the sole 1012 transitions from the columns of three support structures in the heel region of the sole 1012, to a single support structure (e.g., 1020) in the forefoot spanning the distance between the footbed surface 1009 and the outsole surface 1011. Support structures arranged in columns may also be referred to as "axially aligned," which describes two or more support structures that are aligned longitudinally (e.g., along the longitudinal orientation of the axis), sequentially (not concentrically) along a common axis, such that the axes of the axially aligned support structures are substantially coaxial. Although only support structures along the lateral side are identified in FIGS. 10A-10C, the three stack arrangement continues in adjacent rows as the system moves from the lateral side of the sole to the medial side of the sole. Similarly, a row of single support structures aligned with the support structure 1020 extends from the lateral side to the medial side.

As illustrated by FIGS. 10A-C, the system of support structures gradually transitions from the three-stack arrangement in the heel region (e.g., column of three support structures) to the single support structure in the forefoot. For example, the sole 1012 includes a two-stack arrangement with structures 1040A and 1040B in a midfoot region (e.g., structures 1040A and 1040B are aligned in a column) and between the three-stack arrangement and the single support structure 1020. As such, as the sole 1012 transitions from the heel region to the midfoot region to the forefoot region, the sole 1012 transitions from a three-stack arrangement to a two-stack arrangement to a single support structure.

Each of the three support structures 1022A-C in the heel region, the two support structures 1040A-B in the midfoot, and the single support structure 1020 in the forefoot includes respective dimensions, such as height, diameter, and wall thickness. The gradual transition from a three stack to a two stack to a single support structure may include a constant set of respective dimensions across all support structures. Or, in another embodiment, the respective dimensions may gradually change as the system of structures transitions from the three stack down to the single support structure, in order to tune the support structure to achieve a functionality or performance in a particular portion of the sole structure 1012. For example, in FIGS. 10A-10C, the height of the single support structure 1020 is larger than the individual heights of each of the support structures 1022A-C. In addition, the height of support structures positioned between the three-stack arrangement and the single support structure may be smaller than the single support structure 1020 and larger than the individual height of the support structures in the three stack. In another aspect, the wall thickness of the support structures may transition from a thicker wall in the heel region (e.g., 0.85 mm to 1.5 mm) to thinner walls in the forefoot region (e.g., 0.50 mm to 1.15 mm), or from thinner walls in the heel region (e.g., 0.50 mm to 1.15 mm) to thicker walls in the forefoot region (e.g., 0.85 mm to 1.5 mm).

For illustrative purposes, FIGS. 11A-E depict illustrations of a footwear article 1110 including a sole 1112, which is similar to the sole 1012. For example, the sole 1112 includes a system of support structures that transitions from a three-stack arrangement (e.g., 1122A, 1122B, and 1122C) in the heel region down to a single support structure 1120 in the forefoot. As indicated above, each of the support structures might include similar dimensions, such as height, diameter, and wall thickness. Or in an alternative embodiment, these dimensions might gradually change from one portion of the sole 1112 to another portion.

As described in other portions of this disclosure, the soles 1012 and 1112 provide cushioning and energy return and are lighter weight than some soles constructed in accordance with some traditional technologies (e.g., solid foam soles). Because the support structures (e.g., 1020, 1120, 1022, 1122, and 1140) contribute to the cushioning and functionality, less base material is used, as compared to systems that rely more on the material properties of the base foam material. In addition, the configuration of the support structures (e.g., minimal surface) allows for a force load (e.g., ground contact upon foot strike when running) to be more evenly spread throughout the system, providing a consistent cushion throughout the initial phase of the applied force load. Furthermore, the support structures of the soles 1012 and 1112 are more durable, and less susceptible to breakage, tearing, or rupture (as compared with other types of support structures, such as struts), since the force load is applied evenly throughout the walls of the support structures and load points are minimized.

Soles constructed in accordance with aspects of this disclosure have been shown to provide a load attenuation that is different from other soles, and as used herein, "load attenuation" refers to act of reducing a force. For example, referring to FIG. 9 a line graph is depicted showing test results that depict sole deflection on the horizontal axis relative to force on the vertical axis. The deflection range is divided into an initial compression zone 914, a transition zone 916, and a final compression zone 918.

In general, the data is collected and measured by using a load-application device to actively apply a force to a predetermined value. For example, in one aspect data might be collected by dropping a 7.8 kg mass onto a sample and measuring "peak G" and "energy loss" (%). The 7.8 kg mass might take the form of a 4 cm diameter flat tup or ram that impacts one or more zones of a footwear article at 1.0 m/s. Generally, a lower peak G value suggests a softer cushioning, and a higher value indicates firmer cushioning. A difference in peak G values between two samples (e.g., two different sole structures) greater than 0.5 G is often considered to be a meaningful difference (outside the variance of the machine.) Moreover, tests often suggest that a difference in peak G values greater than 1.0 G for a heel impact translates to a subjective assessment by a wearer of a "Just Noticeable Difference" (JND) between the footwear samples. Energy loss is a measure of responsiveness, and the lower the energy loss the more responsive the cushioning. A difference in energy loss greater than 10% often considered to be a meaningful difference between two samples.

Figure 9:
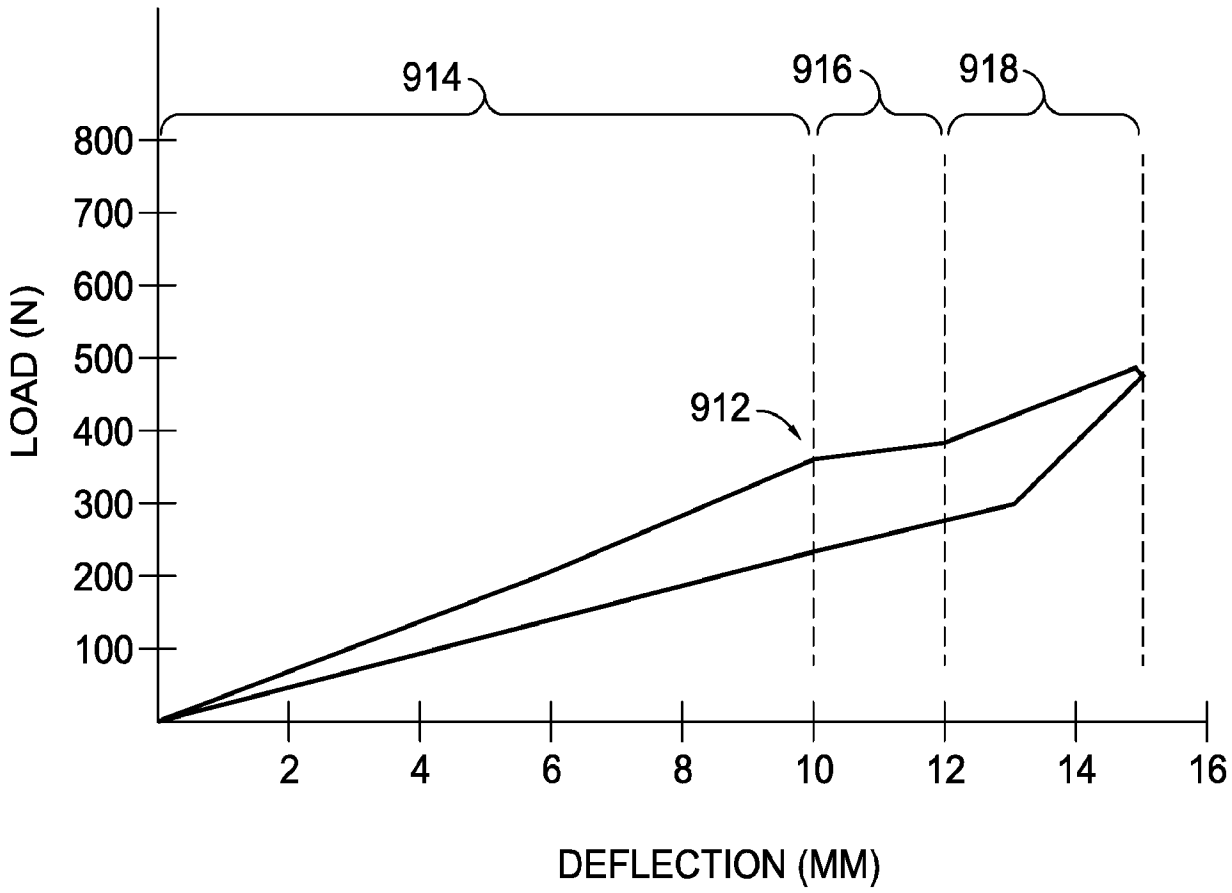
FIG. 9 depicts a graph of test results in accordance with an aspect of this disclosure.

The graph of FIG. 9 illustrates that about 175 N is applied in order to create about 5 mm of deflection, and about 350 N is applied in order to achieve about 10 mm of deflection. On average, up until about 10 mm of deflection, the sole deflects about 2 mm for every additional 70 N of force load, and this is describes the initial compression zone 914. However, once the sole reaches about 10 mm of deflection, less amount of force load is required to deflect the sole an additional 2 mm (i.e., from 10 mm to 12 mm), and according to the graph, this quantity is less than 50 N. This threshold amount of deflection reflects a tipping point 912, at which point the sole structure deflects more easily (with less force required), before the end of the force application, and this describes the transition zone 916. The deflection action of the sole finishes in the final compression zone 918 similarly to the initial compression zone 914. FIG. 9 could depict a single load-attenuation cycle or could represent average values for a single footwear sole structure that is subjected to cycle testing. In one aspect, cycle testing includes repeatedly dropping the tup or ram onto the subject midsole at a frequency correlated to a wearer's footstrike cadence when engaging in a particular activity, such as running.

A few interpretations could be applied to the graph of FIG. 9 to describe the features of the tested sole structure. For example, one feature illustrated by the graph of FIG. 9 is that the first two-thirds of sole deflection (i.e., from zero to 10 mm) occurs relatively linearly, suggesting a smooth and consistent compression under load. A second feature illustrated by the graph of FIG. 9 is that the tipping point, which may simulate or represent a "bottoming out," occurs near the end of the force cycle, and this later-phase tipping point helps to reduce the likelihood that more of the load would be transferred to the wearer's body. In other words, if too much deflection occurs earlier in the load cycle, then the sole has less ability to continue compressing as more force is applied, and this additional force would be transferred to the wearer. Another feature is illustrated by the final compression zone 918, which might suggest that the support-structure walls themselves continue to compress (e.g., compress from a thicker wall thickness to a thinner wall thickness), even after the support structures themselves might have folded or buckled, and this additional compression provides additional cushioning functionality.

In a further aspect, once the sole structure has reached the end of the final compression zone 918, the rebound resilience of the material of the sole structure contributes to the rate at which the sole structure transforms or "springs" back to the resting state, when no load is applied. For example, if a sole is constructed of a less resilient material with a lower bounce percentage, then the deflection might remain much higher after the final compression zone 918, until a much larger amount of the load had been removed.

Some aspects of this disclosure have been described with respect to the examples provided by FIGS. 1-11E. Additional aspects of the disclosure will now be described that may be related subject matter included in one or more claims or clauses of this application, or one or more related applications, but the claims or clauses are not limited to only the subject matter described in the below portions of this description. These additional aspects may include features illustrated by FIGS. 1-11E, features not illustrated by FIGS. 1-11E, and any combination thereof. When describing these additional aspects, reference may be made to elements depicted by FIGS. 1-11E for illustrative purposes.

As such, one aspect of the present disclosure includes a support structure for a footwear sole, and examples of a support structure include, but are not limited to, each of the items identified by reference numerals 20, 120, 220, 320, 620-632, 720, 722, 820, 822, and 840. A support structure might be included in a footwear sole or in a system of support structures, or might exist as a separate component, such as prior to be incorporated into a footwear sole. The support structure includes a tubular body including a wall that at least partially encloses a hollow cavity and that extends circumferentially around the hollow cavity. In addition, the tubular body comprising a first end and a second end that are spaced apart from one another in an axial direction. The wall curves inward as the wall extends between the first end and the second end. Furthermore, the wall includes an exterior surface facing away from the hollow cavity, the exterior surface being concave as it extends from the first end and the second end. The wall also includes an interior surface facing towards the hollow cavity, the interior surface being convex as it extends from the first end to the second end. As explained in other parts of this disclosure, the configuration of the support structure might contribute to a more even force distribution, as compared with a structure that has more joints, edges, or corners.

Another aspect of the present disclosure includes a support-structure arrangement for a footwear sole. It should be noted that the term "system" is also used in this disclosure to refer to a support-structure arrangement. The support-structure arrangement includes at least a first support structure and at least a second support structure. In other words, the arrangement might include two support structures and might include more than two support structures. For example, the support structures 120 and 220 might make up a support-structure arrangement. Likewise, the support structures 120 and 320 might make up a support-structure arrangement. In addition, the support structures 120, 220, and 320 might make up a support-structure arrangement. Furthermore, the system 410 or the system 610 might make up a support-structure arrangement. These are merely examples. In one aspect of a support-structure arrangement, each of the support structures includes a tubular body including a wall that at least partially encloses a hollow cavity and that extends circumferentially around the hollow cavity. In addition, the tubular body of each support structure includes a first end and a second end that are spaced apart in an axial direction, and the wall of each support structure curves inward as the wall extends between the first end and the second end. The wall includes an exterior surface facing away from the hollow cavity and an interior surface facing towards the hollow cavity. In one aspect, the first support structure and the second support structure are arranged end-to-end. For example, the support structure 120 is end-to-end, and axially offset from, the support structure 220. Moreover, a first portion of the exterior surface of the first support structure is continuous with a portion of the interior surface of the second support structure. As explained in other parts of this disclosure, the continuous, gradual, and smooth transition from one support structure to another might contribute to a more even force distribution within the system.

An additional aspect of the disclosure is directed to a footwear sole having a ground-contacting outsole coupled to an impact-attenuation midsole. The ground-contacting outsole has a ground-contacting surface that faces away from the impact-attenuation midsole and that is positioned in a reference plane. The footwear sole also includes a support structure having a tubular body including a wall that at least partially encloses a hollow cavity and that extends circumferentially around a reference axis. The reference axis intersects the reference plane at an angle in a range of about 30 degrees to about 60 degrees. The tubular body includes a first end and a second end that are spaced apart in an axial direction. In addition, the wall curves inward towards the reference axis as the wall extends between the first end and the second end.

As used herein and in connection with the clauses listed hereinafter, the terminology "any of clauses" or similar variations of said terminology is intended to be interpreted such that features of clauses may be combined in any combination. For example, an exemplary clause 4 may indicate the method/apparatus of any of clauses 1 through 3, which is intended to be interpreted such that features of clause 1 and clause 4 may be combined, elements of clause 2 and clause 4 may be combined, elements of clause 3 and 4 may be combined, elements of clauses 1, 2, and 4 may be combined, elements of clauses 2, 3, and 4 may be combined, elements of clauses 1, 2, 3, and 4 may be combined, and/or other variations. Further, the terminology "any of clauses" or similar variations of said terminology is intended to include "any one of clauses" or other variations of such terminology, as indicated by some of the examples provided above.

The following clauses are aspects contemplated herein.

Clause 1. A support structure comprising a portion of a footwear sole, the support structure comprising: a tubular body including a wall that at least partially encloses a hollow cavity and that continuously extends circumferentially around the hollow cavity; the tubular body comprising a first end and a second end that are spaced apart from one another in an axial direction; the wall curving inward as the wall extends between the first end and the second end; and the wall comprising an exterior surface facing away from the hollow cavity, wherein the exterior surface is concave as it extends from the first end and the second end; and the wall comprising an interior surface facing towards the hollow cavity, wherein the interior surface is convex as it extends from the first end to the second end.

Clause 2. The support structure of clause 1, wherein the wall forms a catenoid between the first end and the second end as the wall extends circumferentially around the hollow cavity.

Clause 3. The support structure of any of clauses 1 or 2, wherein a configuration of the exterior surface satisfies a minimal-surface equation comprising $\sin(x)*\sin(y)+\cos(y)*\cos(z)=0$.

Clause 4. The support structure of claim 1, wherein the wall comprises a wall thickness between the exterior surface and the interior surface, and wherein the wall thickness is in a range of approximately 0.75 mm to approximately 1.5 mm.

Clause 5. The support structure of claim 4, wherein the wall thickness is in a range of approximately 1.05 mm to approximately 1.15 mm.

Clause 6. The support structure of claim 1, wherein the tubular body includes an interior diameter at the first end and includes a height extending from the first end to the second end, and wherein a ratio of the height to the interior diameter is in a range of approximately 1:1 to approximately 4:1.

Clause 7. A footwear sole comprising a plurality of support structures of any of clauses 1-6.

Clause 8. The footwear sole of clause 7, wherein a first support structure of the plurality includes a first wall thickness, and wherein a second support structure of the plurality including a second wall thickness, which is different from the first wall thickness.

Clause 9. The footwear sole of any of clauses 7 or 8, wherein the footwear sole includes a footbed surface and an outsole surface, wherein the footwear sole includes a first region having a first quantity of support structures arranged both linearly along a first axis and between the footbed surface and the outsole surface, and wherein the footwear sole includes a second region having a second quantity of support structures arranged both linearly along a second axis and between the footbed surface and the outsole surface, the first quantity being larger than the second quantity.

Clause 9b. The footwear sole of clause 9, wherein the first axis is a common axis extending coaxially among the first quantity of support structures.

Clause 10. The footwear sole of clauses 9 or 9b, wherein the first region is more heelward than the second region.

Clause 11. The footwear sole of any of clauses 9, 9b, or 10, wherein the second quantity is one, and wherein the first quantity is three.

Clause 12. The footwear sole of any of clauses 9-12, wherein the outsole surface is positioned in a reference plane; wherein the wall of one or more support structures extends circumferentially around a respective reference axis, which intersects the reference plane at an angle in a range of about 30 degrees to about 60 degrees.

Clause 13. The footwear sole of clause 12, wherein the respective reference axis inclines toward a heel region of the footwear sole, such that the first end of the tubular body is farther from the outsole than the second end and the first end of the tubular body is more heelward relative to the second end.

Clause 14. The footwear sole of any of clauses 7-14 comprising: at least a first support structure and at least a second support structure; the first support structure comprising: a first tubular body including a first wall that at least partially encloses a first hollow cavity and that extends circumferentially around the first hollow cavity, the first tubular body having a first reference axis; the first tubular body comprising a first end and a second end that are spaced apart from one another in an axial direction, wherein the first tubular body includes a first height from the first end to the second end; the first wall curving inward as the first wall extends between the first end and the second end; the first wall comprising a first exterior surface facing away from the first hollow cavity and a first interior surface facing towards the first hollow cavity; the second support structure comprising: a second tubular body including a second wall that at least partially encloses a second hollow cavity and that extends circumferentially around the second hollow cavity, the second tubular body having a second reference axis; the second tubular body comprising a third end and a fourth end that are spaced apart from one another in an axial direction, wherein the second tubular body includes a second height from the third end to the fourth end; the second wall curving inward as the second wall extends between the third end and the fourth end; the second wall comprising a second exterior surface facing away from the second hollow cavity and a second interior surface facing towards the second hollow cavity; the first support structure and the second support structure being arranged end-to-end, such that the second end is coupled with the third end; the first reference axis is offset from the second reference axis; a first portion of the first exterior surface being continuous with, and transitioning uninterruptedly into, a portion of the second interior surface; and a portion of the first interior surface being continuous with, and transitioning uninterruptedly into, a portion of the second exterior surface.

Clause 15. The footwear sole of clause 14 comprising: a third support structure comprising respective elements of: a third tubular body including a third wall that at least partially encloses a third hollow cavity and that extends circumferentially around the third hollow cavity; the third tubular body comprising a fifth end and a sixth end that are spaced apart from one another in an axial direction; the third wall curving inward towards and into the third hollow cavity as the third wall extends between the fifth end and the sixth end; the third tubular wall comprising a third exterior surface facing away from the third hollow cavity and a third interior surface facing towards the third hollow cavity; the first support structure and the third support structure being arranged side-by-side, wherein a second portion of the first exterior surface is continuous with a portion of the third exterior surface, wherein the second portion of the first exterior surface and the portion of the third exterior surface comprise a continuous closed chain surface.

Clause 16. The footwear sole of clause 14, wherein the first interior surface includes a second-end rim positioned at the second end of the first support structure, the second-end rim circumscribing the first reference axis and abutting a first transition from the portion of the first interior surface to the portion of the second exterior surface, the second-end rim having a first diameter; wherein the second interior surface includes a third-end rim positioned at the third end of the second support structure, the third-end rim circumscribing the second reference axis and abutting a second transition from the portion of the second interior surface to the first portion of the first exterior surface, the third-end rim having a second diameter; and wherein the first reference axis and the second reference axis are spaced apart by a distance approximately equal to an average of the first diameter and the second diameter.

Clause 17. The footwear sole of clause 16, wherein a reference line passing through the first transition and the second transition extends parallel to the first reference axis and the second reference axis.

Clause 18. The footwear sole of clause 14, wherein a configuration of the exterior surface of the first support structure and of the exterior surface of the second support structure satisfies a minimal-surface equation comprising $\sin(x)*\sin(y)+\cos(y)*\cos(z)=0$.

Clause 19. A support-structure arrangement for a footwear sole, the support structure arrangement comprising: at least a first support structure and at least a second support structure; the first support structure comprising: a first tubular body including a first wall that at least partially encloses a first hollow cavity and that extends circumferentially around the first hollow cavity, the first tubular body having a first reference axis; the first tubular body comprising a first end and a second end that are spaced apart from one another in an axial direction, wherein the first tubular body includes a first height from the first end to the second end; the first wall curving inward as the first wall extends between the first end and the second end; the first wall comprising a first exterior surface facing away from the first hollow cavity and a first interior surface facing towards the first hollow cavity; the second support structure comprising: a second tubular body including a second wall that at least partially encloses a second hollow cavity and that extends circumferentially around the second hollow cavity, the second tubular body having a second reference axis; the second tubular body comprising a third end and a fourth end that are spaced apart from one another in an axial direction, wherein the second tubular body includes a second height from the third end to the fourth end; the second wall curving inward as the second wall extends between the third end and the fourth end; the second wall comprising a second exterior surface facing away from the second hollow cavity and a second interior surface facing towards the second hollow cavity; the first support structure and the second support structure being arranged end-to-end, such that the second end is coupled with the third end; the first reference axis is offset from the second reference axis; a first portion of the first exterior surface being continuous with, and transitioning uninterruptedly into, a portion of the second interior surface; and a portion of the first interior surface being continuous with, and transitioning uninterruptedly into, a portion of the second exterior surface.

Clause 20. The support-structure arrangement of clause 19, wherein the first interior surface includes a second-end rim positioned at the second end of the first support structure, the second-end rim circumscribing the first reference axis and abutting a first transition from the portion of the first interior surface to the portion of the second exterior surface, the second-end rim having a first diameter; wherein the second interior surface includes a third-end rim positioned at the third end of the second support structure, the third-end rim circumscribing the second reference axis and abutting a second transition from the portion of the second interior surface to the first portion of the first exterior surface, the third-end rim having a second diameter; and wherein the first reference axis and the second reference axis are spaced apart by a distance approximately equal to an average of the first diameter and the second diameter.

Clause 21. The support-structure arrangement of clause 20, wherein a reference line passing through the first transition and the second transition extends parallel to the first reference axis and the second reference axis.

Clause 22. The support-structure arrangement of any of clauses 19-21, wherein a configuration of the exterior surface of the first support structure and of the exterior surface of the second support structure satisfies a minimal-surface equation comprising $\sin(x)*\sin(y)+\cos(y)*\cos(z)=0$.

Clause 23. The support-structure arrangement of any of clauses 19-22 further comprising, a third support structure comprising respective elements of: a third tubular body including a third wall that at least partially encloses a third hollow cavity and that extends circumferentially around the third hollow cavity; the third tubular body comprising a fifth end and a sixth end that are spaced apart from one another in an axial direction; the third wall curving inward towards and into the third hollow cavity as the third wall extends between the fifth end and the sixth end; the third tubular wall comprising a third exterior surface facing away from the third hollow cavity and a third interior surface facing towards the third hollow cavity, the third exterior surface including a configuration that satisfies the minimal-surface equation; the first support structure and the third support structure being arranged side-by-side and axially offset, wherein a second portion of the first exterior surface is continuous with a portion of the third exterior surface, wherein the second portion of the first exterior surface and the portion of the third exterior surface comprise a continuous closed chain surface.

Clause 24. The support-structure arrangement of any of clauses 19-23, wherein the support structures comprise any of clauses 1-6.

Clause 25. The support-structure arrangement of any of clauses 19-24, wherein the support-structure arrangement comprises a portion of a footwear sole.

Clause 26. The support-structure arrangement of clause 25, wherein the footwear sole comprises any of clauses 7-18.

Clause 27. A footwear sole comprising: a ground-contacting outsole coupled to an impact-attenuation midsole, the ground contacting outsole having a ground-contacting surface that faces away from the impact-attenuation midsole and that is positioned in a reference plane; and a support structure comprising: a tubular body including a wall that at least partially encloses a hollow cavity and that extends circumferentially around a reference axis, the reference axis intersecting the reference plane at an angle in a range of about 30 degrees to about 60 degrees; the tubular body comprising a first end and a second end that are spaced apart from one another in an axial direction; and the wall curving inward towards the reference axis as the wall extends between the first end and the second end.

Clause 28. The footwear sole of clause 27, wherein the angle is about 45 degrees.

Clause 29. The footwear sole of clause 27, wherein the reference axis inclines toward a heel region of the footwear sole, such that the first end of the tubular body is farther from the outsole than the second end and the first end of the tubular body is more heelward relative to the second end.

Clause 30. The footwear sole of clause 27 further comprising, a system of support structures; a forefoot region; a midfoot region; and a heel region, wherein each of the forefoot region, the midfoot region, and the heel region includes a respective region of the system of support structures, and wherein each support structure in the system includes the reference axis intersecting the reference plane at an angle in a range of about 30 degrees to about 60 degrees.

Clause 31. The footwear sole of clause 30, wherein one or more support structures in the forefoot region have a wall thickness of about 1.15 mm and one or more support structures in the heel region have a wall thickness of about 1.05 mm.

Clause 32. The footwear sole of any of clauses 30 or 31, wherein each respective region includes one or more rows of side-by-side support structures extending medially to laterally across the footwear sole.

Clause 33. The footwear sole of any of clauses 30-32, wherein each support structure in the system is constructed of a material having a rebound-resilience percentage of at least 50%.

Clause 34. The footwear sole of clause 33, wherein the material includes a thermoplastic polyurethane.

Clause 35. The footwear sole of any of clauses 27-34, wherein the wall comprises an exterior surface facing away from the hollow cavity, and wherein a configuration of the exterior surface satisfies a minimal-surface equation comprising $\sin(x)*\sin(y)+\cos(y)*\cos(z)=0$.

Clause 36. A sole for a footwear article, the sole comprising: a plurality of support structures, wherein each support structure comprises a tubular body including a wall that at least partially encloses a hollow cavity and that extends circumferentially around a reference axis, the tubular body comprising a first end and a second end that are spaced apart from one another in an axial direction; and the wall curving inward towards the reference axis as the wall extends between the first end and the second end; and wherein three support structures of the plurality of support structures are coaxial along a common axis in a first region of the midsole and are spaced apart along the common axis; and wherein a second region of the midsole includes a single support structure of the plurality of support structures, and wherein the single support structure is not coaxial along any common axis with any other support structures of the plurality of support structures.

Clause 37. The sole of claim 36, wherein the first region is closer than the second region to a heel region of the sole.

Clause 38. The sole of clause 36 or 37 further comprising, two support structures that are coaxially aligned with one another and are positioned between the three support structures and the single support structure.

Clause 39. The sole of any of clauses 36-38, wherein the three support structures each include a first dimension, and the single support structure includes a second dimension which is different from the first dimension.

Clause 40. The sole of clause 39, wherein the first dimension and the second dimension are each a support-structure height.

Clause 41. The sole of any of clauses 39 or 40, wherein the first dimension is smaller than the second dimension.

Clause 42. The sole of any of clauses 39-42, wherein the first dimension and the second dimension are each a wall-thickness.

Subject matter set forth in this disclosure, and covered by at least some of the claims, may take various forms, such as a cushioning structure for a midsole, a cushioning system for a midsole, a midsole for a footwear article, a footwear article, any combination thereof, and one or more methods of making each of these aspects or making any combination thereof. Other aspects include a method of tuning a cushioning structure for a midsole, as well as a method of tuning a cushioning system for a midsole.

From the foregoing, it will be seen that subject matter described in this disclosure is adapted to attain the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible alternative versions may be made of the subject matter described herein, without departing from the scope of this disclosure, it is to be understood that all matter herein set forth or shown in the accompanying drawings is to be interpreted as illustrative and not in a limiting sense.

The invention claimed is:

1. A support-structure arrangement for a footwear sole, the support-structure arrangement comprising:

at least a first support structure and at least a second support structure;

the first support structure comprising:

a first tubular body including a first wall that at least partially encloses a first hollow cavity and that extends circumferentially around the first hollow cavity, the first tubular body having a first reference axis;

the first tubular body comprising a first end and a second end that are spaced apart from one another in a first axial direction, wherein the first tubular body includes a first height from the first end to the second end;

the first wall curving inward as the first wall extends between the first end and the second end;

the first wall comprising a first exterior surface facing away from the first hollow cavity and a first interior surface facing towards the first hollow cavity;

the second support structure comprising:

a second tubular body including a second wall that at least partially encloses a second hollow cavity and that extends circumferentially around the second hollow cavity, the second tubular body having a second reference axis;

the second tubular body comprising a third end and a fourth end that are spaced apart from one another in a second axial direction, wherein the second tubular body includes a second height from the third end to the fourth end;

the second wall curving inward as the second wall extends between the third end and the fourth end;

the second wall comprising a second exterior surface facing away from the second hollow cavity and a second interior surface facing towards the second hollow cavity;

wherein the first support structure and the second support structure are arranged end-to-end, such that the second end is coupled with the third end;

wherein the first reference axis is offset from the second reference axis;

wherein a first portion of the first exterior surface is continuous with, and transitions uninterruptedly into, a second portion of the second interior surface; and wherein a third portion of the first interior surface is continuous with, and transitions uninterruptedly into, a fourth portion of the second exterior surface.

2. The support-structure arrangement of claim 1, wherein the first interior surface includes a second-end rim positioned at the second end of the first support structure, the second-end rim circumscribing the first reference axis and abutting a first transition from the third portion of the first interior surface to the fourth portion of the second exterior surface, the second-end rim having a first diameter, wherein the second interior surface includes a third-end rim positioned at the third end of the second support structure, the third-end rim circumscribing the second reference axis and abutting a second transition from the second portion of the second interior surface to the first portion of the first exterior surface, the third-end rim having a second diameter, and wherein the first reference axis and the second reference axis are axially offset by a distance approximately equal to an average of the first diameter and the second diameter.

3. The support-structure arrangement of claim 2, wherein a reference line passing through the first transition and the second transition extends parallel to the first reference axis and the second reference axis.

4. The support-structure arrangement of claim 3, wherein a configuration of the first exterior surface of the first support structure and of the second exterior surface of the second support structure satisfies a minimal-surface equation comprising $\sin(x)*\sin(y)+\cos(y)*\cos(z)=0$.

5. The support-structure arrangement of claim 2 further comprising, a third support structure comprising respective elements of:

a third tubular body including a third wall that at least partially encloses a third hollow cavity and that extends circumferentially around the third hollow cavity;

the third tubular body comprising a fifth end and a sixth end that are spaced apart from one another in a third axial direction;

wherein the third wall curves inward towards and into the third hollow cavity as the third wall extends between the fifth end and the sixth end;

the third wall comprising a third exterior surface facing away from the third hollow cavity and a third interior surface facing towards the third hollow cavity;

wherein the first support structure and the third support structure are arranged side-by-side and axially offset, wherein a fifth portion of the first exterior surface is continuous with a sixth portion of the third exterior surface, wherein the fifth portion of the first exterior surface and the sixth portion of the third exterior surface comprise a continuous closed chain surface.

6. A footwear sole comprising:

a ground-contacting outsole coupled to an impact-attenuation midsole, the ground-contacting outsole having a ground-contacting surface that faces away from the impact-attenuation midsole and that is positioned in a reference plane; and the impact-attenuation midsole comprising a system of support structures, each support structure in the system of support structures comprising:

a tubular body including a wall comprising an exterior surface and an interior surface, wherein the wall at least partially encloses a hollow cavity and extends circumferentially around a reference axis, the reference axis intersecting the reference plane at an angle in a range of 30 degrees to about 60 degrees;

the tubular body comprising a first end and a second end that are spaced apart from one another in an axial direction, wherein the hollow cavity continuously extends from the first end to the second end; and the exterior surface and the interior surface of the wall curving inward towards the reference axis as the wall extends between the first end and the second end.

7. The footwear sole of claim 6, wherein the angle is about 45 degrees.

8. The footwear sole of claim 6, wherein the reference axis inclines toward a heel region of the footwear sole, such that the first end of the tubular body is farther from the ground-contacting outsole than the second end and the first end of the tubular body is more heelward relative to the second end.

9. The footwear sole of claim 8 further comprising, a forefoot region;

a midfoot region; and wherein each of the forefoot region, the midfoot region, and the heel region includes a respective region of the system of support structures.

10. The footwear sole of claim 9, wherein one or more first support structures in the forefoot region have a first wall thickness of about 1.15 mm and one or more second support structures in the heel region have a second wall thickness of about 1.05 mm.

11. The footwear sole of claim 9, wherein the respective region of the system of support structures is comprised of one or more rows of side-by-side support structures extending from a medial side to a lateral side across the footwear sole.

12. The footwear sole of claim 11, wherein the each support structure in the system of support structures is constructed of a material having a rebound-resilience percentage of at least 50%.

13. The footwear sole of claim 12, wherein the material includes a thermoplastic polyurethane.

14. The footwear sole of claim 6, wherein a configuration of the exterior surface satisfies a minimal-surface equation comprising $\sin(x)*\sin(y)+\cos(y)*\cos(z)=0$.

15. A footwear sole comprising:

at least a first support structure, at least a second support structure, and at least a third support structure;

the first support structure comprising, a first tubular body including a first wall that at least partially encloses a first hollow cavity and that extends circumferentially around the first hollow cavity, the first tubular body having a first reference axis; the first tubular body comprising a first end and a second end spaced apart from one another in a first axial direction; and the first wall comprising a first exterior surface facing away from the first hollow cavity and a first interior surface facing towards the first hollow cavity;

the second support structure comprising, a second tubular body including a second wall that at least partially encloses a second hollow cavity and that extends circumferentially around the second hollow cavity, the second tubular body having a second reference axis; the second tubular body comprising a third end and a fourth end spaced apart from one another in a second axial direction; and the second wall comprising a second exterior surface facing away from the second hollow cavity and a second interior surface facing towards the second hollow cavity;

the third support structure comprising, a third tubular body including a third wall that at least partially encloses a third hollow cavity and that extends circumferentially around the third hollow cavity, the third tubular body comprising a fifth end and a sixth end that are spaced apart from one another in a third axial direction;

the first support structure and the second support structure arranged end-to-end, such that the first end of the first support structure is coupled with the third end of the second support structure;

the first support structure and the second support structure being offset from one another, such that the first reference axis and the second reference axis are parallel to, and not coaxial with, one another;

a portion of the first exterior surface continuous with, and transitioning uninterruptedly into, a portion of the second interior surface;

a portion of the first interior surface continuous with, and transitioning uninterruptedly into, a portion of the second exterior surface; and the third wall of the third support structure comprising a third exterior surface facing away from the third hollow cavity and a third interior surface facing towards the third hollow cavity, wherein a second portion of the first exterior surface is continuous with a portion of the third exterior surface, and wherein the second portion of the first exterior surface and the portion of the third exterior surface comprise a continuous closed chain surface.

16. The footwear sole of claim 15, wherein the first interior surface includes a first-end rim positioned at the first end, the first-end rim circumscribing the first reference axis and abutting a first transition from the portion of the first interior surface to the portion of the second exterior surface, the first-end rim having a first diameter, wherein the second interior surface includes a third-end rim positioned at the third end, the third-end rim circumscribing the second reference axis and abutting a second transition from the portion of the second interior surface to the portion of the first exterior surface, the third-end rim having a second diameter, and wherein the first reference axis and the second reference axis are spaced apart by a distance approximately equal to an average of the first diameter and the second diameter.

17. The footwear sole of claim 16, wherein a reference line passing through the first transition and the second transition extends parallel to the first reference axis and the second reference axis.

18. The footwear sole of claim 15, wherein the first wall curves inward towards and into the first hollow cavity as the first wall extends from the first end to the second end, and wherein the second wall curves inward towards and into the second hollow cavity as the second wall extends from the third end to the fourth end.

19. The footwear sole of claim 18, wherein the first support structure forms a first catenoid and the second support structure forms a second catenoid.

20. The footwear sole of claim 15, wherein the first support structure and the second support structure comprise a height ranging from 0.75 cm to 1.5 cm.

* * * * *